US010383503B2

(12) United States Patent
Suda

(10) Patent No.: US 10,383,503 B2
(45) Date of Patent: Aug. 20, 2019

(54) CLEANING TOOL

(71) Applicant: UNI-CHARM CORPORATION, Ehime (JP)

(72) Inventor: Tomokazu Suda, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 515 days.

(21) Appl. No.: 14/766,438

(22) PCT Filed: Jan. 24, 2014

(86) PCT No.: PCT/JP2014/051587
§ 371 (c)(1),
(2) Date: Aug. 6, 2015

(87) PCT Pub. No.: WO2014/123012
PCT Pub. Date: Aug. 14, 2014

(65) Prior Publication Data

US 2015/0359404 A1 Dec. 17, 2015

(30) Foreign Application Priority Data

Feb. 7, 2013 (JP) ..... 2013-022762

(51) Int. Cl.
*A47L 13/38* (2006.01)
*A47L 13/12* (2006.01)
(Continued)

(52) U.S. Cl.
CPC ..... *A47L 13/38* (2013.01); *A47L 13/12* (2013.01); *A47L 13/44* (2013.01); *A47L 13/10* (2013.01); *A47L 13/16* (2013.01); *A47L 13/20* (2013.01)

(58) Field of Classification Search
CPC ..... A47L 13/38; A47L 13/12; A47L 13/44; A47L 13/16; A47L 13/20; A47L 13/10
(Continued)

(56) References Cited

U.S. PATENT DOCUMENTS 9,089,252 B2 * 7/2015 Tsuchiya ..... A47L 13/20

FOREIGN PATENT DOCUMENTS

EP 1967119 A2 9/2008
EP 1974648 A2 10/2008
(Continued)

OTHER PUBLICATIONS

Extended European Search Report in EP Application No. 14749282.1, dated Aug. 8, 2016.
(Continued)

*Primary Examiner* — Monica S Carter
*Assistant Examiner* — Katina N. Henson
(74) *Attorney, Agent, or Firm* — Hauptman Ham, LLP

(57) ABSTRACT

To provide a cleaning tool exhibiting excellent cleaning effectiveness. The present invention relates to a cleaning tool comprising a cleaning sheet, and a holding tool for holding said cleaning sheet. The cleaning sheet is provided with: a brush part; a base part; and insertion parts through which holding parts of the holding tool are inserted. The brush part is provided with a plurality of strip pieces. The strip pieces include first strip pieces, and second strip pieces having a higher rigidity than the first strip pieces. The second strip pieces are provided with scrape-out parts capable of scraping out dust on an object to be cleaned.

16 Claims, 22 Drawing Sheets

(51) Int. Cl.

| | |
|---|---|
| ***A47L 13/44*** | (2006.01) |
| *A47L 13/16* | (2006.01) |
| *A47L 13/20* | (2006.01) |
| *A47L 13/10* | (2006.01) |

(58) Field of Classification Search
USPC ..... 15/229.4, 114
See application file for complete search history.

(56) References Cited

FOREIGN PATENT DOCUMENTS

| | | | | | |
|---|---|---|---|---|---|
| EP | 1982627 | A1 * | 10/2008 | ..... | A47L 13/20 |
| EP | 2308361 | A1 | 4/2011 | | |
| JP | 2007-135666 | A | 6/2007 | | |
| JP | 2007-137566 | A | 6/2007 | | |

OTHER PUBLICATIONS

Written Opinion of the ISA in PCT application No. PCT/JP2014/051587, dated Apr. 28, 2014.
International Search Report dated Apr. 28, 2014 in International Application No. PCT/JP2014/051587.
Office Action in ID Application No. P00201505393, dated Aug. 21, 2018, 6pp.

* cited by examiner

CLEANING TOOL

RELATED APPLICATIONS

The present application is a National Phase of International Application Number PCT/JP2014/051587, filed Jan. 24, 2014, and claims priority of Japanese Patent Application No. 2013-022762 filed on Feb. 7, 2013.

TECHNICAL FIELD

The present invention relates to a cleaning tool for cleaning an object to be cleaned. Further, internal applications of PCT/JP2014/050859, PCT/JP2014/050860, PCT/JP2014/051585 and PCT/JP2014/051586 are respectively incorporated by reference.

BACKGROUND ART

Japanese Unexamined Patent Application Publication (JP-A) No. 2007-137566 discloses a cleaning article having a grip insertion part, and a fiber layer and a scraping sheet which are provided on each of the upper and lower sides of the grip insertion part. The grip insertion part is formed by a pair of grip attaching sheets. When used, the cleaning article is attached to a grip.

Ends of this cleaning article in its transverse direction has a zigzag shape.

PRIOR ART DOCUMENT

Patent Document

Patent Document 1: JP-A No. 2007-137566

SUMMARY OF THE INVENTION

Problem to be Solved by the Invention

In the cleaning article disclosed in JP-A No. 2007-137566, ends of the cleaning article in its transverse direction has a zigzag shape, so that the cleaning article has a function of scraping out dust on an object to be cleaned. When fibers of the fiber layer become entangled with each other, however, the cleaning article cannot fully exert the scraping-out function.

Accordingly, it is an object of the present invention to provide a cleaning tool having an excellent cleaning effect.

Means for Solving the Problem

In order to solve the above problem, according to a preferred aspect of the present invention, a cleaning tool having a cleaning sheet and a holder for holding the cleaning sheet is provided. The cleaning sheet is configured to extend in a longitudinal direction which is defined by a direction of insertion of the holder into the cleaning sheet, and in a transverse direction which is defined by a direction crossing the longitudinal direction. The holder has a holding part for holding the cleaning sheet, and a grip part which is connected to the holding part and designed to be held by a user. The cleaning sheet has a brush part capable of cleaning an object to be cleaned, a base connected with the brush part, and an insertion part which is formed on the base and for insertion of the holding part. The brush part includes a plurality of strips formed by strip-like sheets, and the strips include first strips and second strips having a higher rigidity than the first strips. Each of the second strips has a scraping-out part capable of scraping out dust on the object to be cleaned.

In a further aspect of the cleaning tool according to the present invention, the second strip has a high rigidity region.

In a further aspect of the cleaning tool according to the present invention, each of the strips is configured to extend in a strip longitudinal direction which is defined by a direction in which the strip extends in an elongate form, and in a strip transverse direction which is defined by a direction crossing the strip longitudinal direction, and the high rigidity region is configured to extend in the strip longitudinal direction.

In a further aspect of the cleaning tool according to the present invention, the second strips are provided in end regions of the cleaning sheet in the cleaning sheet longitudinal direction.

In a further aspect of the cleaning tool according to the present invention, the second strips are provided in a central region of the cleaning sheet in the cleaning sheet longitudinal direction.

In a further aspect of the cleaning tool according to the present invention, the second strips are provided in end regions of the cleaning sheet in the cleaning sheet transverse direction.

In a further aspect of the cleaning tool according to the present invention, the second strips are provided in a central region of the cleaning sheet in the cleaning sheet transverse direction.

In a further aspect of the cleaning tool according to the present invention, the first strips and the second strips are alternately arranged.

In a further aspect of the cleaning tool according to the present invention, the base is formed by a first sheet element.

In a further aspect of the cleaning tool according to the present invention, the base has a plurality of cuts in end regions of the first sheet element, and the strips are formed between the cuts.

In a further aspect of the cleaning tool according to the present invention, the cleaning tool has a second sheet element which is superposed on the first sheet element, and the insertion part is formed between the first sheet element and the second sheet element.

In a further aspect of the cleaning tool according to the present invention, the insertion part is formed by forming a bonding sheet region by contact of prescribed surfaces of the first sheet element with each other and bonding the prescribed surfaces in the bonding sheet region.

In a further aspect of the cleaning tool according to the present invention, the cleaning tool has a third sheet element which is superposed on the first sheet element, and a fourth sheet element which is superposed on the third sheet element, and the insertion part is formed between the third sheet element and the fourth sheet element.

In a further aspect of the cleaning tool according to the present invention, the cleaning tool has a fifth sheet element which is superposed on the first sheet element, and the insertion part is formed by forming a bonding sheet region by contact of prescribed surfaces of the fifth sheet element with each other and bonding the prescribed surfaces in the bonding sheet region.

In a further aspect of the cleaning tool according to the present invention, the brush part is provided on one side of the base.

In a further aspect of the cleaning tool according to the present invention, the brush part is provided on one side and the other side of the base.

Effect of the Invention

According to the present invention, a cleaning tool having an excellent cleaning effect can be provided by a scraping-out part of second strips.

BEST MODES FOR CARRYING OUT THE INVENTION (Outline of Cleaning Tool)

An embodiment of the present invention is now described with reference to FIGS. 1 to 10. A structure of a cleaning tool A as one embodiment of a "cleaning tool" according to the present invention is now explained. Objects to be cleaned by using the cleaning tool A typically include surfaces to be cleaned (floors, walls, windows, ceilings, external walls, furniture, clothes, curtains, bedding, lighting, home electric appliances, etc.) inside and outside of houses, apartments, buildings, factories, vehicles, etc. and surfaces of human body parts to be cleaned. The surfaces to be cleaned may be either flat or curved, uneven or stepped.

Figure 1:
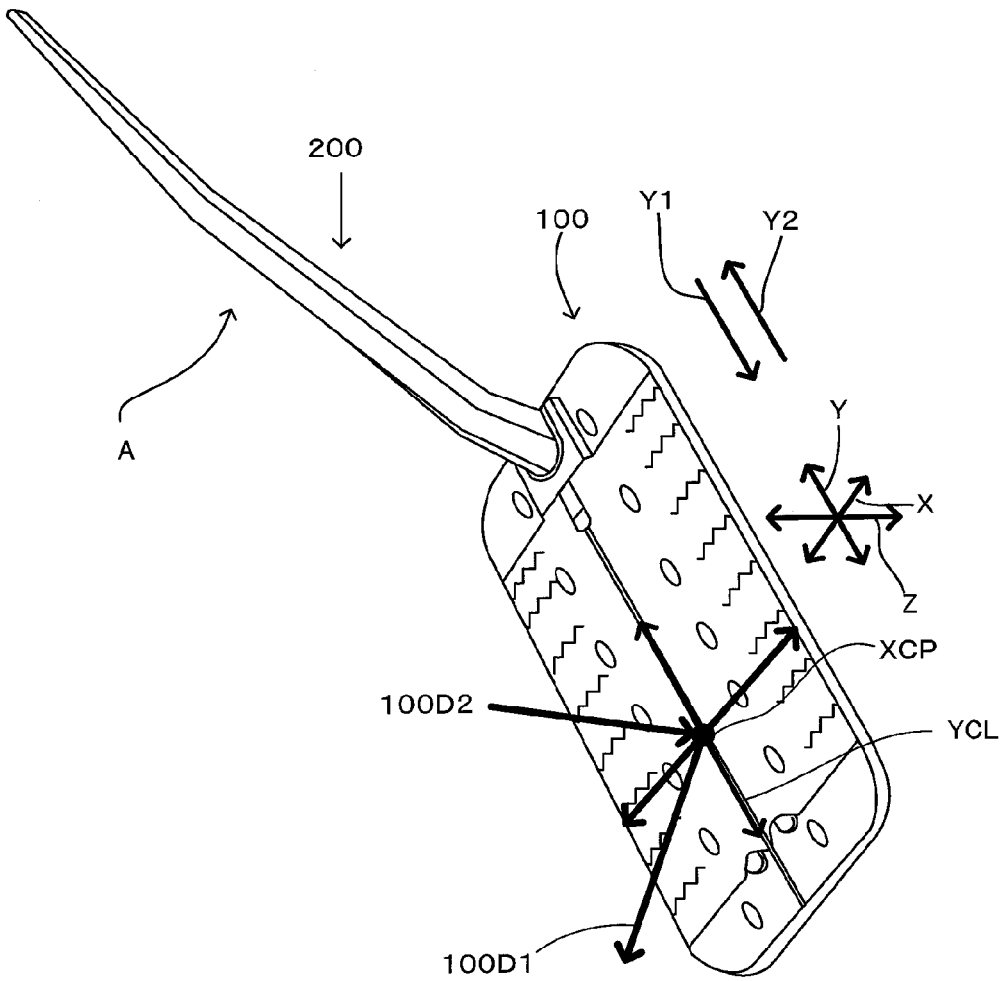
FIG. 1 is a perspective view showing an overall structure of a cleaning tool according to an embodiment of the present invention.

As shown in FIG. 1, the cleaning tool A includes a cleaning element holder 200 and a cleaning element 100. The cleaning element holder 200 is configured to be removably attached to the cleaning element 100 and to hold the cleaning element 100. The cleaning tool A, the cleaning element holder 200 and the cleaning element 100 are example embodiments that correspond to the "cleaning tool", the "holder" and the "cleaning sheet", respectively, according to this invention.

The cleaning element 100 is configured to extend in a cleaning element longitudinal direction Y and a cleaning element transverse direction X crossing the cleaning element longitudinal direction Y. The cleaning element longitudinal direction Y is defined by a direction parallel to a direction of insertion of the cleaning element holder 200 into the cleaning element 100. The direction of insertion of the cleaning element holder 200 into the cleaning element 100 is defined as an inserting direction Y1, and a direction opposite to the inserting direction Y1 is defined as a pulling-out direction Y2.

A direction crossing the cleaning element longitudinal direction Y and the cleaning element transverse direction X is defined as a thickness direction Z. The term "crossing" as used in this specification means "perpendicularly crossing" unless otherwise specified.

The cleaning element longitudinal direction Y and the cleaning element transverse direction X are example embodiments that correspond to the "cleaning sheet longitudinal direction" and the "cleaning sheet transverse direction", respectively, according to this invention.

The cleaning element 100 has ends 100B in the cleaning element longitudinal direction and ends 100A in the cleaning element transverse direction. Each of the ends 100B has a central region 100BC including its center, and each of the ends 100A has a central region 100AC including its center.

A center point of the cleaning element 100 in the transverse direction X is defined as a transverse direction center point XCP. The transverse direction center point XCP can be formed on a line passing through any point on the cleaning element 100 in the transverse direction X.

A line passing through the transverse direction center point XCP in parallel to the longitudinal direction Y is defined as a longitudinal center line YCL.

A direction away from the transverse direction center point XCP of the cleaning element 100 is defined as an outside direction 100D1, and a direction toward the transverse direction center point XCP of the cleaning element 100 is defined as an inside direction 100D2.

(Structure of the Cleaning Element Holder)

Figure 2:
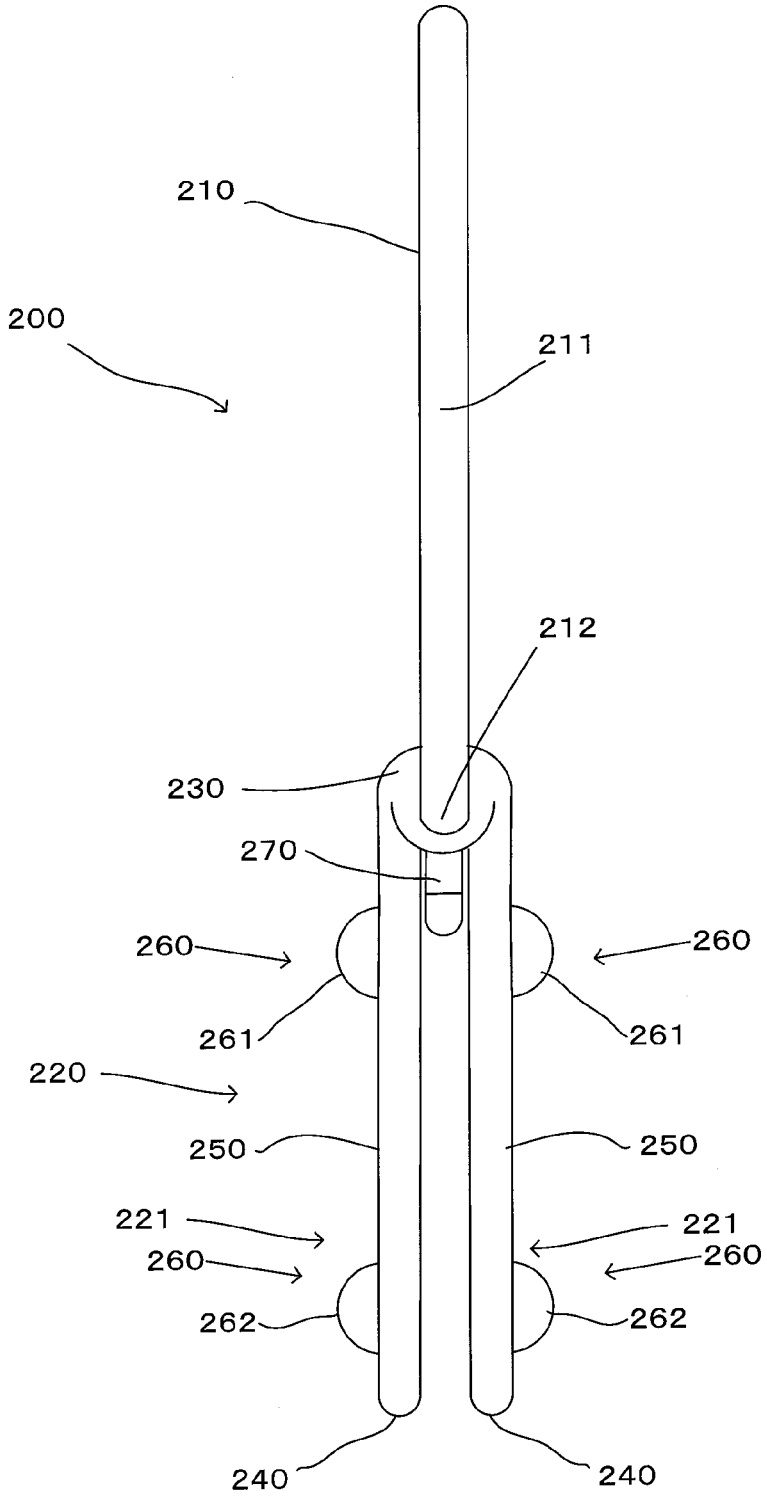
FIG. 2 is a plan view of a cleaning element holder.

As shown in FIG. 2, the cleaning element holder 200 mainly includes a handle part 210 and a cleaning element holding part 220. The handle part 210 is an elongate member to be held by a user during cleaning. The handle part 210 has a handle 211 and a handle connecting part 212. The handle connecting part 212 is connected to a connection part 230 of the cleaning element holding part 220. The handle 211 extends in an elongate form from the handle connecting part 212. The handle part 210 and the cleaning element holding part 220 are example embodiments that correspond to the "grip part" and the "holding part", respectively, according to this invention.

The cleaning element holding part 220 is a member formed of resin material and configured to hold the cleaning element 100. The cleaning element holding part 220 mainly includes a pair of elongate holding members 221, a projection 260 and a retaining plate 270. Specifically, polypropylene (PP) is used to form the cleaning element holding part 220. Flexible resin materials, such as polyethylene (PE), polyethylene terephthalate (PET), acrylonitrile butadiene styrene (ABS) and thermoplastic polyester elastomer, can be appropriately selected for the cleaning element holding part 220.

Each of the holding members 221 extends from the connection part 230 in a direction opposite to the direction in which the handle 211 extends. Specifically, the holding member 221 has the connection part 230, a tip part 240 and an intermediate part 250 extending from the connection part 230 to the tip part 240. The tip part 240 of the holding member 221 is a free end.

The projection 260 is formed in the outside direction 100D1 in the intermediate part 250. The projection 260 includes a first projection 261 formed on the connection part 230 side and a second projection 262 formed on the tip part 240 side.

The retaining plate 270 protrudes from the connection part 230 and extends parallel to the pair holding members 221 therebetween. The retaining plate 270 is convexly curved downward, and further has an engagement lug (not shown) on the underside.

(Structure of the Cleaning Element)

Figure 4:
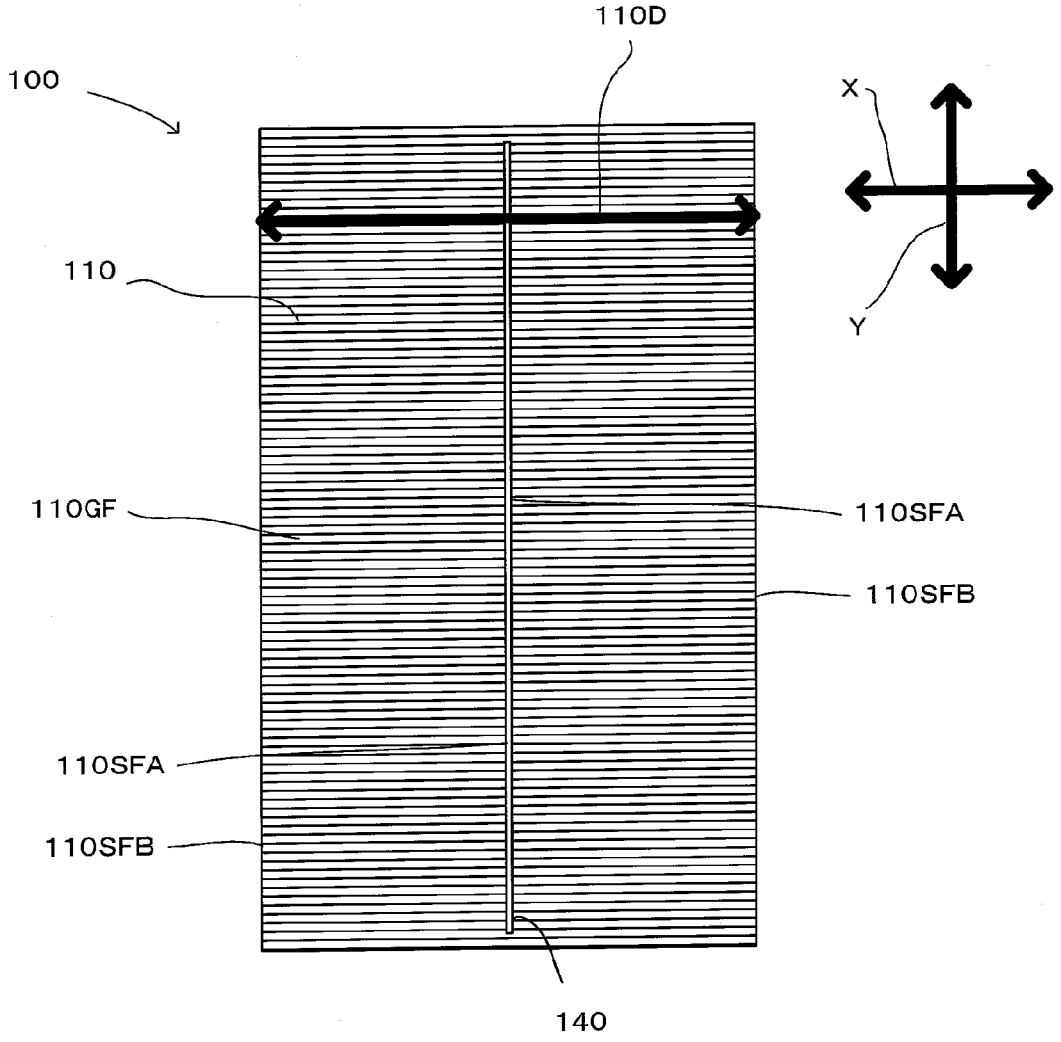
FIG. 4 is a plan view of the cleaning element as viewed from a brush part side.
Figure 5:
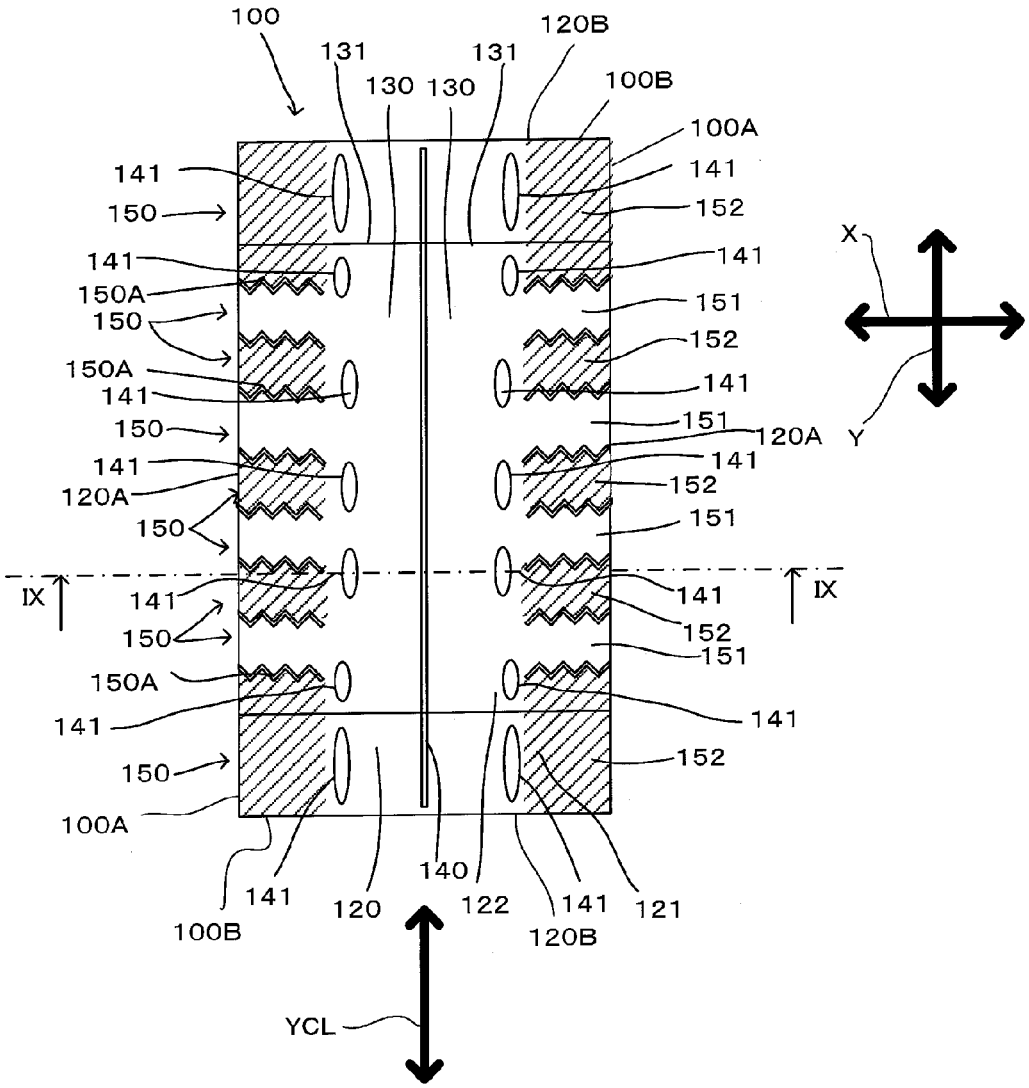
FIG. 5 is a plan view of the cleaning element as viewed from a second sheet element side.

The cleaning element 100 is now explained with reference to FIGS. 3 to 5. The cleaning element 100 has a sheet-like form and has a dirt collecting function of collecting dust or dirt on an object to be cleaned. As shown in FIGS. 4 and 5, the cleaning element 100 is rectangular in plan view.

The cleaning element 100 may be of disposable type designed for single use, disposable type designed for multiple use which can be used several times, while holding dust or dirt collected from the cleaning surface to be cleaned, or reusable type which can be reused by washing.

A base 120 of the cleaning element 100 is formed by a first sheet element 121. The base 120 has ends 120A in the transverse direction X and ends 120B in the longitudinal direction Y, and one side 120C and the other side 120D. The base 120, the first sheet element 121, the one side 120C and the other side 120D are example embodiments that correspond to the "base", the "first sheet element", the "one side" and "the other side", respectively, according to this invention.

A fiber assembly 110GF is disposed on the one side 120C of the base 120. A second sheet element 122 is disposed on the other side 120D of the base 120.

The base 120, the fiber assembly 110GF and the second sheet element 122 which are thus superposed one on the other extend in an elongate form in the longitudinal direction Y of the cleaning element 100.

The fiber assembly 110GF forms a brush part 110 having a dirt collecting function, together with strips 150 which are described below. The fiber assembly 110GF and the brush part 110 are example embodiments that correspond to the "fiber assembly" and the "brush part", respectively, according to this invention.

The fiber assembly 110GF is formed by an assembly of fibers 110SF. In this invention, the fiber 110SF is a single fiber structure formed by typical fibers, a fiber structure having typical fibers aligned in the length direction and/or the radial direction (twist yarn, spun yarn, yarn to which a plurality of filaments are partially connected), or an assembly of the fiber structures. The "typical fibers" as used herein are components of yarn, textile or the like and are thin and flexible fibers having a substantially longer length compared with the thickness. Typically, a long continuous fiber is defined as a filament and a short fiber as a staple.

The fibers 110SF contain thermoplastic fibers in part and can be fusion bonded (or welded).

The fiber assembly 110GF is formed of fibers 110SF which are arranged side by side along a prescribed direction of fiber orientation 110D and stacked in the thickness direction Z. In this embodiment, the direction of fiber orientation 110D substantially coincides with the transverse direction X. The fibers 110SF are flexible and thus easily bent and deformed. Therefore, the direction of fiber orientation 110D of the fibers 110SF refers to the fiber orientation in design of the product.

The fibers 110SF of the fiber assembly 110GF have a connection end 110SFA which is welded to a central bonded part 140. Further, the fibers 110SF have an open end 110SFB on the opposite side to the connection end 110SFA. The open end 110SFB is a free end.

Figure 3:
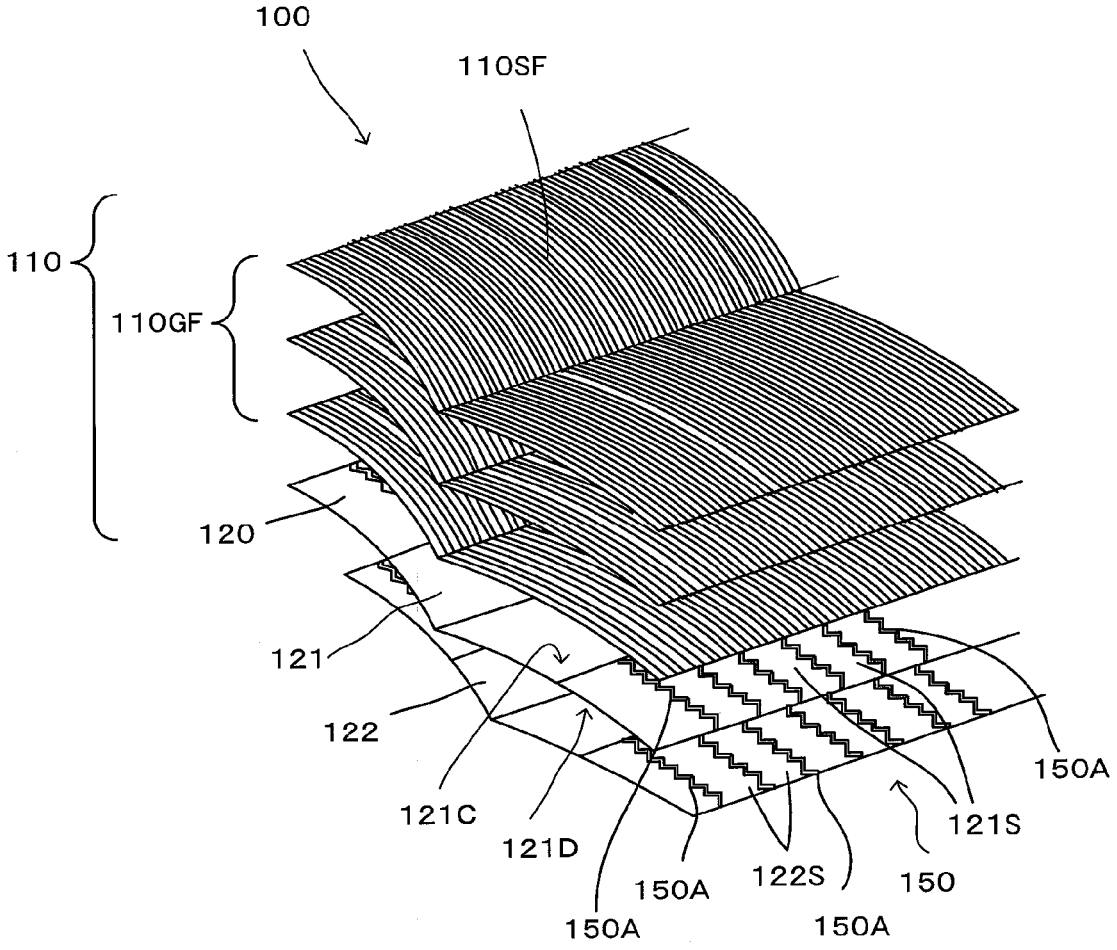
FIG. 3 is a perspective view of a cleaning element, in a state separated into elements.

In FIG. 3, the fiber assembly 110GF is formed by three fiber layers, but the number of fiber layers may be one or more other than three as necessary. Preferably, the fiber assembly 110GF has a planar structure having a predetermined flat or curved surface and has a three-dimensional form having a certain thickness or has a thin sheet-like form. The fiber assembly 110GF is typically formed of polyethylene (PE), polypropylene (PP), polyethylene terephthalate (PET), nylon, rayon or the like. In practical use, an assembly of filaments formed by opening a tow is preferably used as the fiber assembly 110GF. It is particularly preferable that the fiber assembly 110GF comprises conjugated fibers having a core of polypropylene (PP) or polyethylene terephthalate (PET) and a core covering sheath of polyethylene (PE). Further, the fibers 110SF of the fiber assembly 110GF preferably have a fineness of 1 to 50 dtex, or more preferably 2 to 10 dtex. Each fiber assembly may contain fibers of substantially the same fineness, or it may contain fibers of different finenesses.

Further, in order to enhance the dirt collecting function in cleaning, oil is applied to the fiber assembly 110GF. The oil is mainly composed of liquid paraffin.

Further, in order to enhance the sweeping-out function in cleaning, it is preferred to use the fiber assembly 110GF including the fibers 110SF having higher rigidity or the fibers 110SF having higher fineness. It is further preferred that the fiber assembly 110GF has crimped fibers. Here, the crimped fibers are fibers subjected to a prescribed crimping process and easily intertwined with each other. By using such crimped fibers, the fiber assembly 110GF becomes bulkier than before the cleaning element holder 200 is attached to the cleaning element, and dust can be easily captured by the crimped portions. This structure can be realized especially by using crimped fibers opened from tows.

As shown in FIG. 5, the second sheet element 122 is a rectangular nonwoven fabric sheet which is shorter than the base 120 in the longitudinal direction Y.

The base 120 (the first sheet element 121) and the second sheet element 122 are typically formed of sheet-like nonwoven fabric comprising thermal melting fibers (thermoplastic fibers). Therefore, the base 120 and the second sheet element 122 are also referred to as "nonwoven fabric sheet". In order to enhance the sweeping-out function in cleaning, it is preferred to use the nonwoven fabric having higher rigidity.

The nonwoven fabric is formed of synthetic fibers such as polyethylene (PE), polypropylene (PP) and polyethylene terephthalate (PET). Further, the nonwoven fabric is manufactured by through-air bonding or spun bonding.

Not only the nonwoven fabric, however, cloth or synthetic resin film may also be used.

The base 120 and the second sheet element 122 are welded at the central bonded part 140 extending along the longitudinal center line YCL of the cleaning element 100, and at a plurality of first bonded parts 141 arranged on the both sides of the central bonded part 140. Specifically, as shown in FIG. 5, the base 120, the second sheet element 122 and the fiber assembly 110GF are welded at the central bonded part 140. Further, the base 120, the second sheet element 122 and part of the fiber assembly 110GF are welded at the first bonded parts 141. The first bonded parts 141 located on the both end regions in the longitudinal direction Y are formed in positions where the second sheet element 122 does not exist. Therefore, the first bonded parts 141 located on the both end regions in the longitudinal direction Y only bond the base 120 and part of the fiber assembly 110GF.

A pair of holding spaces 130 are formed between the base 120 and the second sheet element 122 in a region between the central bonded part 140 and the first bonded parts 141 and extend in the longitudinal direction Y. Each of the holding spaces 130 has openings 131 on the both ends in the longitudinal direction Y. The holding space 130 is an example embodiment that corresponds to the "insertion part" according to this invention.

In other words, the holding spaces 130 are defined by a prescribed region of the base 120 and a prescribed region of the second sheet element 122 which extend between the pair first bonded parts 141 in the transverse direction X.

The first bonded parts 141 are continuously formed substantially along the longitudinal direction Y. It is not necessary for adjacent ones of the first bonded parts 141 in the longitudinal direction Y to be aligned in the longitudinal direction Y. The arrangement pattern of the first bonded parts 141 can be appropriately designed according to the design and the shape of the cleaning element holding part 220. Naturally, the first bonded part 141 may also be formed in a continuous linear shape.

The central bonded part 140 and the first bonded parts 141 are formed by heat welding.

The bonded parts according to this invention may also be formed by ultrasonic welding, sewing or adhesives such as a hot-melt adhesive.

The cleaning element 100 has strips 150. The strips 150 include strips 121S formed between a plurality of cuts in the end regions of the base 120 in the transverse direction X, and strips 122S formed between a plurality of cuts in the end regions of the second sheet element 122 in the transverse direction X. The cuts in the base 120 and the second sheet element 122 are formed in zigzag. By provision of the zigzag strips 150, a structure having an excellent cleaning function, or particularly a function capable of easily catching and capturing dust or dirt can be realized. Further, the strips 150 may have a single kind or plural kinds of shapes appropriately selected from various shapes, such as zigzag, linear and curved shapes.

The strips 150 according to this invention form the brush part 110 together with the fiber assembly 110GF. The strips 150 may be formed by either the strips 121S of the base 120 or the strips 122S of the second sheet element 122. Specifically, it is sufficient for the strips 150 to be formed in either one of the sheets for forming the cleaning element 100. In this sense, the cuts for forming the strips 150 are referred to as cut parts 150A.

The strip 150 is an example embodiment that corresponds to the "strip" according to this invention.

Figure 6:
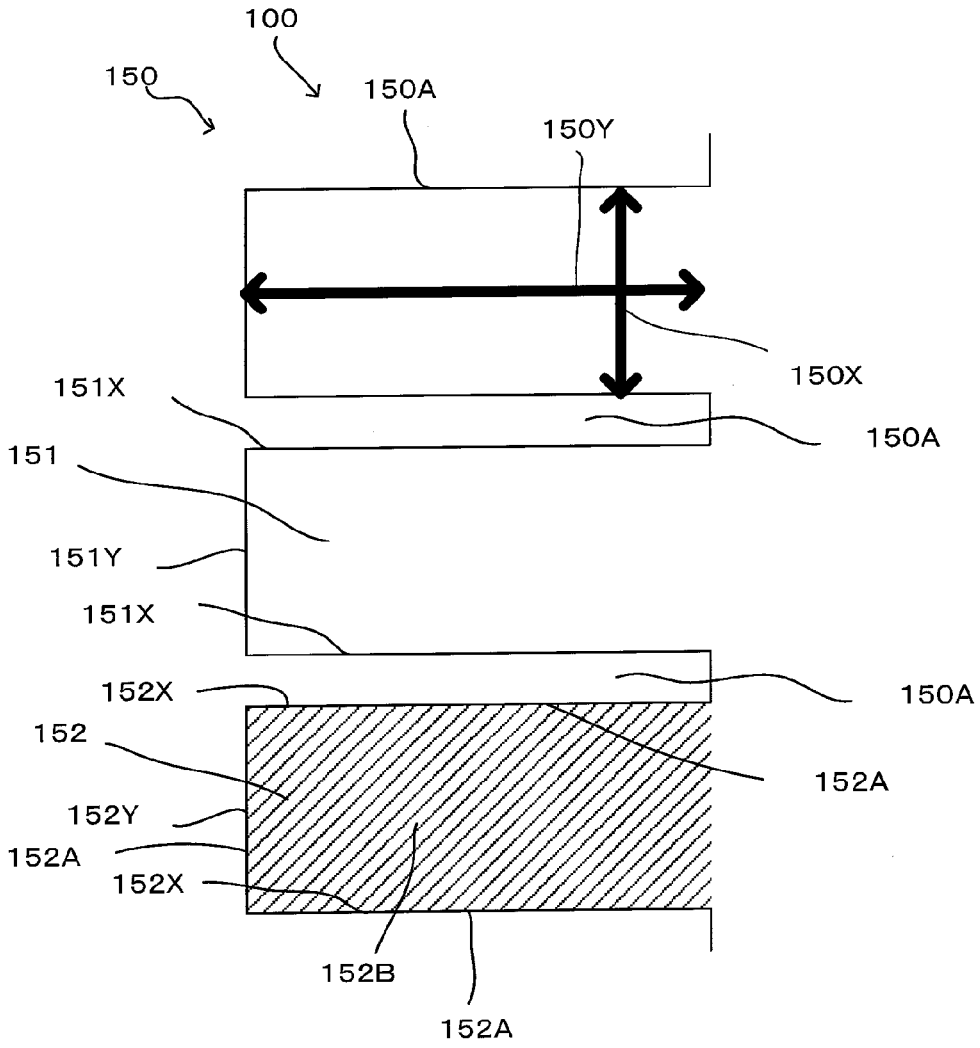
FIG. 6 is an explanatory drawing showing the structure of a strip.
Figure 7:
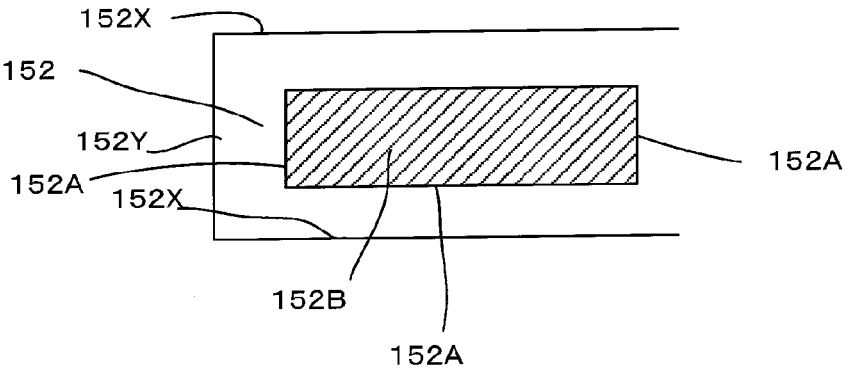
FIG. 7 is an explanatory drawing showing the structure of a strip.
Figure 8:
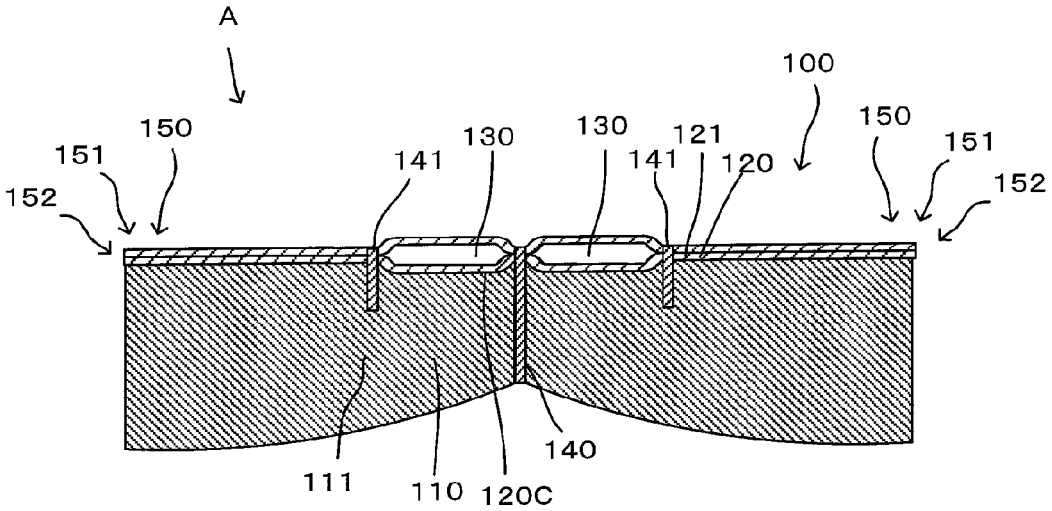
FIG. 8 is a sectional view taken along line IX-IX in FIG. 5.

The specific structure of the strips 150 is now explained with reference to FIGS. 5 to 7. In FIGS. 6 and 7, for the sake of convenience, the cut parts 150A are shown as having a linear shape.

The strips 150 include first strips 151 and second strips 152 having a higher rigidity than the first strips 151. In this embodiment of the invention, the second strips 152 are thermally embossed. Specifically, each of the first strips 151 has the rigidity of 51.2 mm/25 mm, and each of the second strips 152 has the rigidity of 67.6 mm/25 mm, when measured by a cantilever method of JIS/L1096. The second strip 152 has a scraping-out part 152A capable of scraping out dust on an object to be cleaned.

The first strip 151, the second strip 152 and the scraping-out part 152A are example embodiments that correspond to the "first strip", "second strip" and the "scraping-out part", respectively, according to this invention.

The second strip 152 has a high rigidity region 152B. The high rigidity region 152B is provided and configured to improve rigidity of the second strip 152. The second strip 152 in this embodiment is subjected to thermal embossing as described above to form the high rigidity region 152B. The high rigidity region 152B may be provided by other structures. For example, it may be formed by impregnating the second strip 152 with a hot-melt adhesive. Other methods such as sticking nonwoven fabric to the second strip 152, or subjecting the second strip 152 to heat melting can also be appropriately selected.

The high rigidity region 152B is an example embodiment that corresponds to the "high rigidity region" according to this invention.

The strip 150 is configured to extend in a strip longitudinal direction 150Y which is defined by a direction in which the strip 150 extends in an elongate form, and in a strip transverse direction 150X which is defined by a direction crossing the strip longitudinal direction 150Y. The strip longitudinal direction 150Y and the strip transverse direction 150X are example embodiments that correspond to the "strip longitudinal direction" and the "strip transverse direction", respectively, according to this invention.

The first strip 151 has an end 151Y in the strip longitudinal direction 150Y and ends 151X in the strip transverse direction 150X, and the second strip 152 has an end 152Y in the strip longitudinal direction 150Y and ends 152X in the strip transverse direction 150X.

The high rigidity region 152B is configured to extend in the strip longitudinal direction 150Y. As a result, the second strip 152 is reinforced in the strip longitudinal direction 150Y.

The scraping-out part 152A is formed on the ends of the high rigidity region 152B.

In FIG. 6, the high rigidity region 152B is formed over the second strip 152. In such a case, the scraping-out part 152A corresponds to the ends 152X, 152Y of the second strip 152.

On the other hand, in FIG. 7, the high rigidity region 152B is formed in part of the second strip 152. In such a case, the scraping-out part 152A is formed on ends of the high rigidity region 152B on the second strip 152

In the cleaning element 100, the first strips 151 and the second strips 152 are formed on the ends 100A of the cleaning element 100 in the cleaning element transverse direction X. Further, the first strips 151 and the second strips 152 are alternately arranged.

(Engagement of the Cleaning Element Holder and the Cleaning Element)

Figure 9:
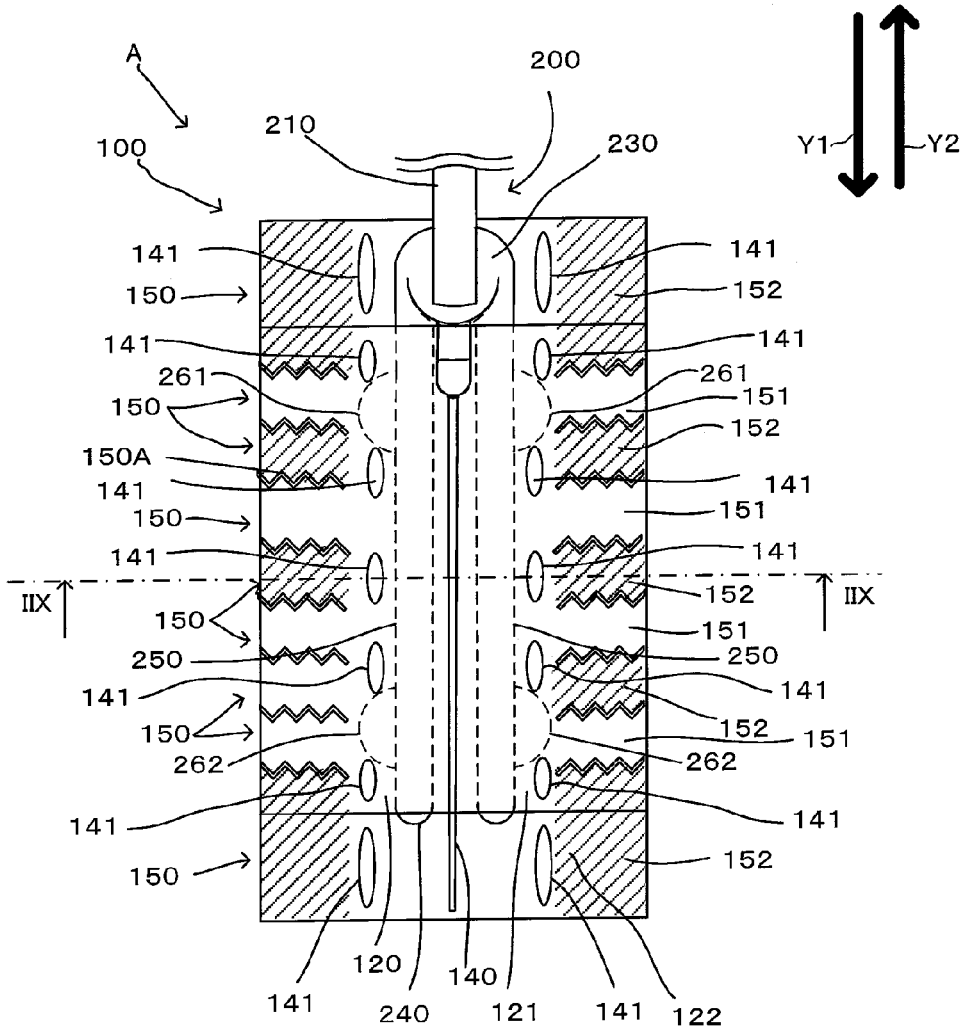
FIG. 9 is a drawing for showing engagement of the cleaning element holder with the cleaning element.
Figure 10:
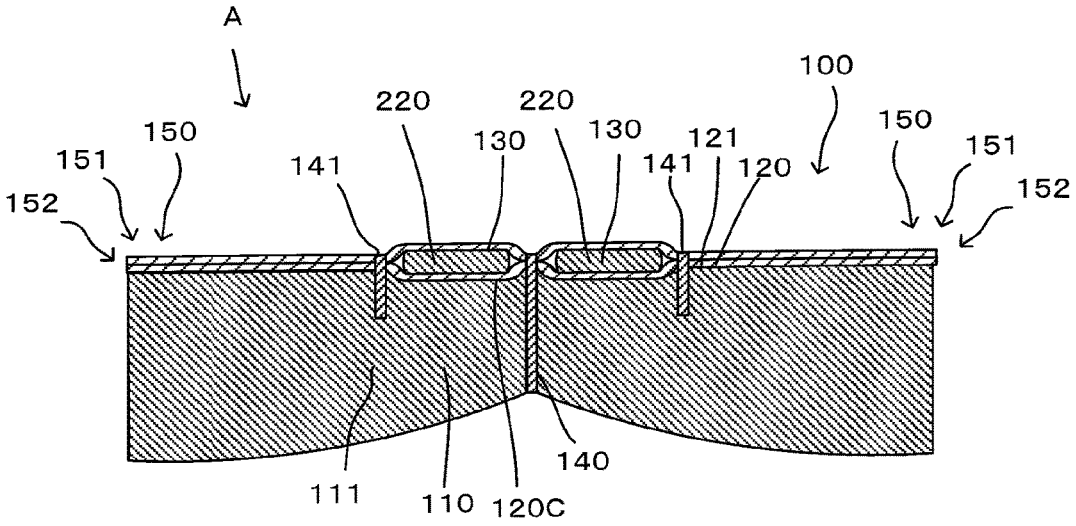
FIG. 10 is a sectional view taken along line IIX-IIX in FIG. 9.

Engagement of the cleaning element holder 200 and the cleaning element 100 is explained with reference to FIGS. 9 and 10. As shown in FIG. 9, the holding members 221 can be inserted into the holding spaces 130. The cleaning element 100 is held by the cleaning element holder 200 by inserting the holding members 221 into the holding spaces 130 along the inserting direction Y1. In order to disengage the cleaning element holder 200 and the cleaning element 100 from each other, the cleaning element holder 200 is pulled out of the holding spaces 130 along the pulling-out direction Y2.

When the cleaning element holder 200 and the cleaning element 100 are engaged with each other, the projection 260 is located between the adjacent first bonded parts 141. As a result, the engagement between the cleaning element holder 200 and the cleaning element 100 is reliably maintained.

Further, the second sheet element 122 is held between the retaining plate 270 and the holding members 221.

(Operation)

Figure 11:
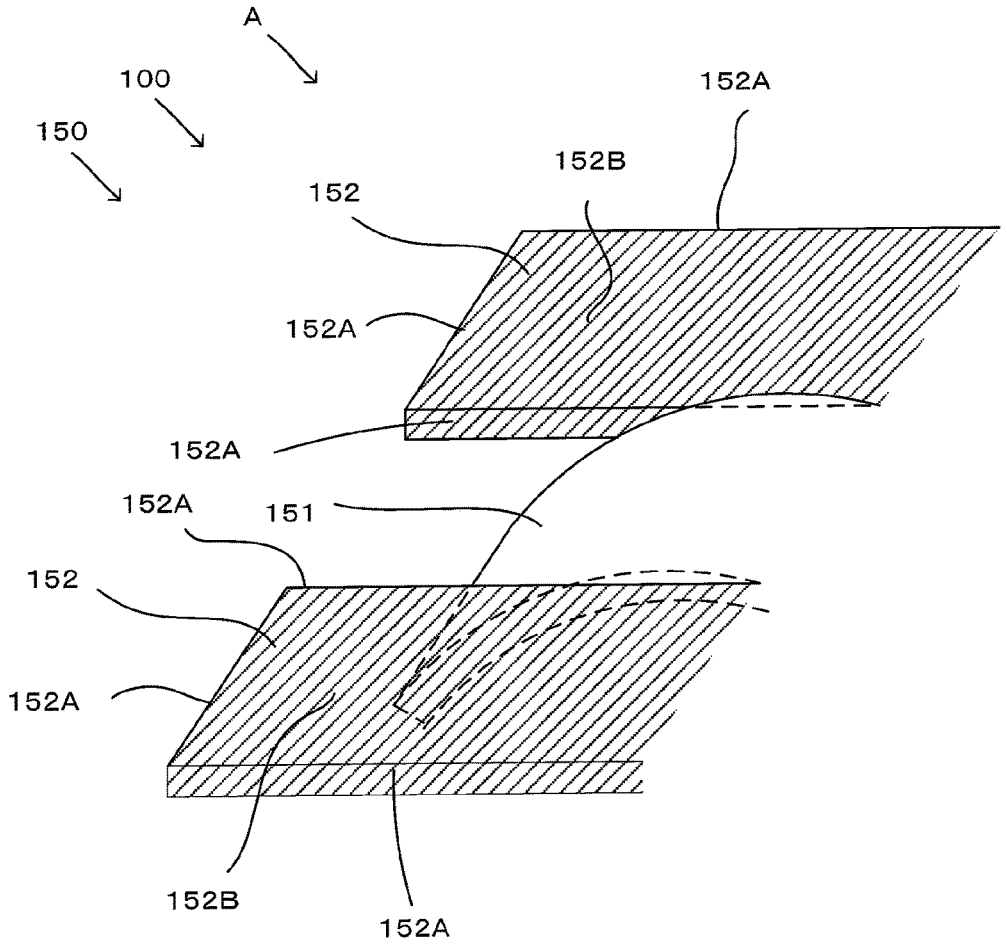
FIG. 11 is an explanatory drawing for illustrating the usage state of the cleaning tool.

Operation of the cleaning tool A according to this invention is now explained with reference to FIG. 11. In FIG. 11, for the sake of convenience, the cut parts 150A are shown as having a linear shape.

When a user puts the end 100A of the cleaning element 100 in the transverse direction X in contact with the object to be cleaned, the scraping-out part 152A of the second strip 152 comes in contact with the object to be cleaned. Then, when the user continues to operate the cleaning tool A, dust is scraped out by the scraping-out part 152A. At this time, the second strip 152 having the high rigidity region 152B does not deform to such an extent as to have considerable adverse effect on the scraping-out work. When the user further continues to operate the cleaning tool A, the first strip 151 comes in contact with the object to be cleaned and deforms. Then, when the user further continues to operate the cleaning tool A, another second strip 152 comes in contact with the object to be cleaned. In this manner, a plurality of the second strips 152 can be successively brought in contact with the object to be cleaned since the first strips 151 and the second strips 152 are alternately formed. Further, the scraped-out dust is captured by the fiber assembly 110GF.

With the cleaning tool A according to this invention, dust can be efficiently scraped out. Therefore, the cleaning tool A of this invention can improve the cleaning efficiency.

The present invention is not limited to the above-described embodiment, but rather, may be added to, changed, replaced with alternatives or otherwise modified. For example, in the cleaning tool A of the above-described embodiment, the holder 200 is provided with the two holding members 221, and correspondingly the cleaning element 100 is provided with the two holding spaces 130. However, a single holding space 130 may be provided for the two holding members 221, or a single holding member 221 and a single holding space 130 may be provided.

Now, modifications to the above-described embodiment are explained. Components identical or corresponding to those in the cleaning tool A of the above-described embodiment are given like numerals and are not described.

(First Modification)

Figure 12:
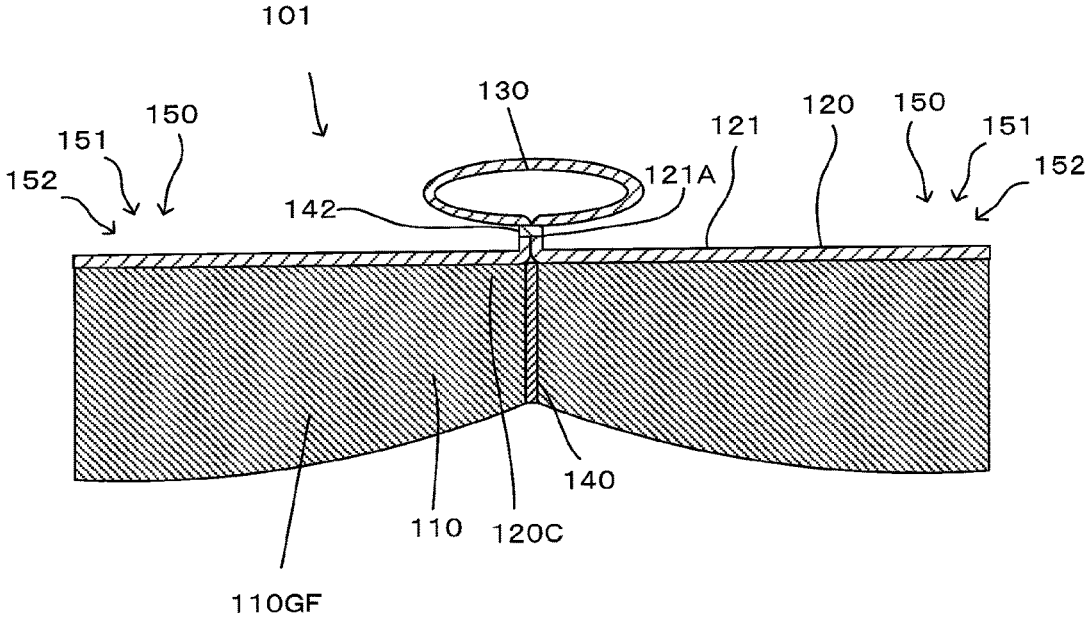
FIG. 12 is an explanatory drawing of a cleaning element according to a first modification of the present invention.

A first modification is explained with reference to FIG. 12. A cleaning element 101 of the first modification is different in the structure of the holding space 130 from the cleaning element 100 of the above-described embodiment.

In the cleaning element 101 of the first modification, the holding space 130 is formed only by the first sheet element 121 forming the base 120. Specifically, a bonding sheet region 121A is formed by contact of prescribed surfaces of the first sheet element 121 with each other. A prescribed area of the bonding sheet region 121A is then welded to form a second bonded part 142.

In this manner, the holding space 130 extending in the longitudinal direction Y is formed.

In the first modification, the central bonded part 140 bonds only the brush part 110. The brush part 110 and the base 120 can be bonded together, for example, by an adhesive (not shown).

In the cleaning element 101 of the first modification, the first strips 151 and the second strips 152 are also formed, so that the same effect as the cleaning element 100 of the above-described embodiment can be obtained.

(Second Modification)

Figure 13:
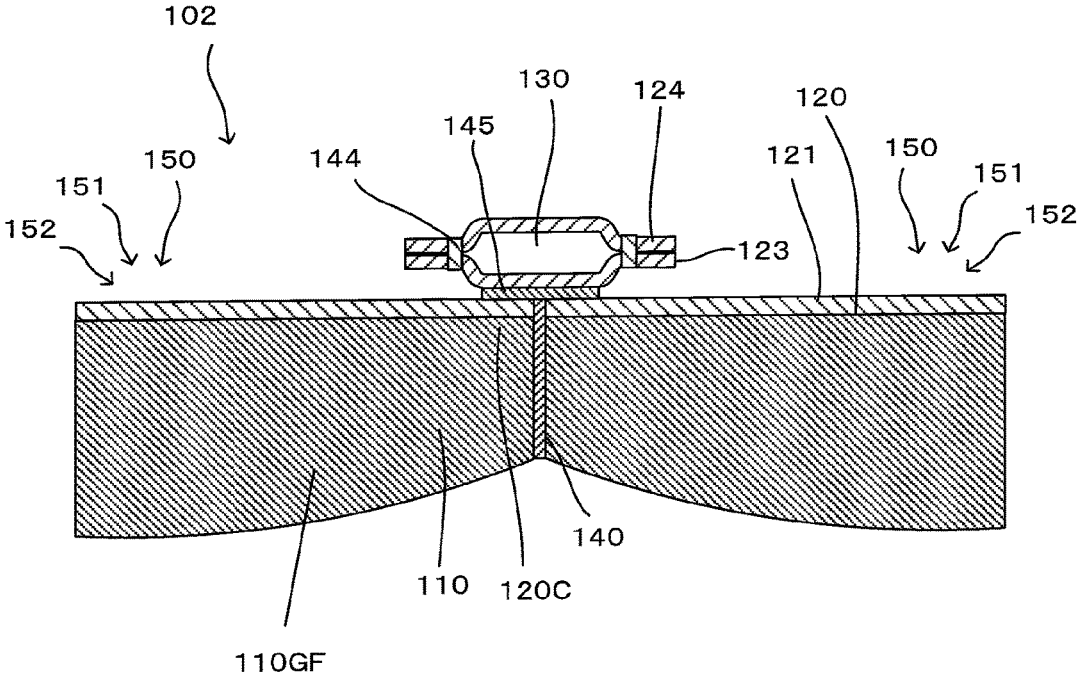
FIG. 13 is an explanatory drawing of a cleaning element according to a second modification of the present invention.

A second modification is explained with reference to FIG. 13. A cleaning element 102 of the second modification is different in the structure of the holding space 130 from the cleaning element 100 of the above-described embodiment.

In the cleaning element 102 of the second modification, the holding space 130 is formed separately from the base 120. A third sheet element 123 and a fourth sheet element 124 are superposed. Regions of the third sheet element 123 and the fourth sheet element 124 close to their ends in the transverse direction X are then welded together along the longitudinal direction Y to form a fourth bonded part 144.

In this manner, the holding space 130 extending in the longitudinal direction Y is formed between the third sheet element 123 and the fourth sheet element 124.

In the second modification, the central bonded part 140 bonds only the brush part 110 and the base 120. The third sheet element 123 is bonded to the base 120, for example, by an adhesive, to form a fifth bonded part 145.

In the cleaning element 102 of the second modification, the first strips 151 and the second strips 152 are also formed, so that the same effect as the cleaning element 100 of the above-described embodiment can be obtained.

(Third Modification)

Figure 14:
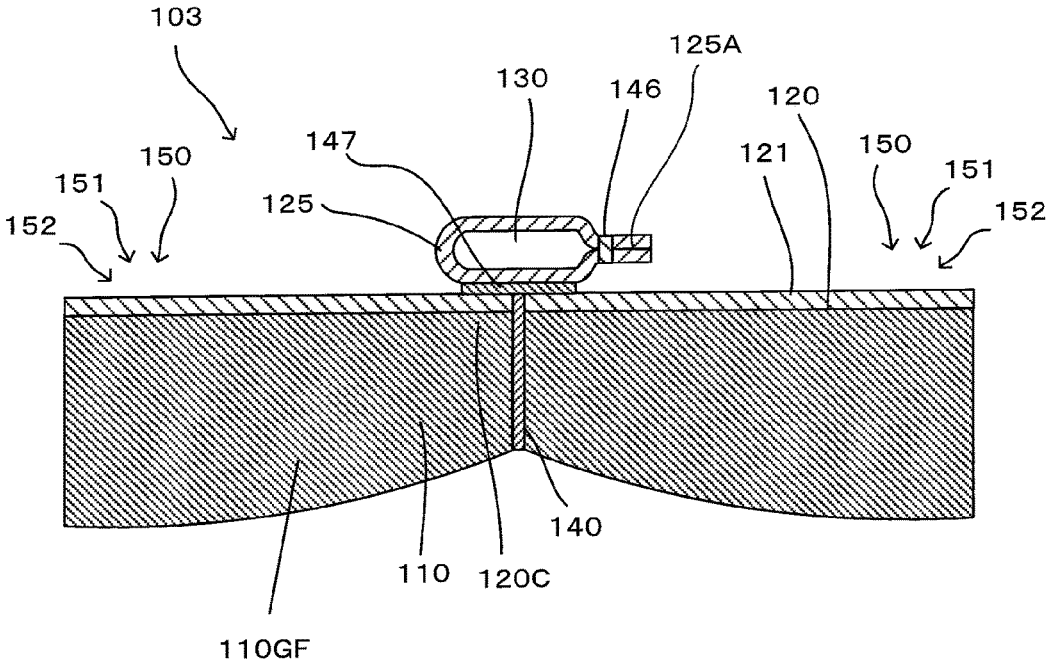
FIG. 14 is an explanatory drawing of a cleaning element according to a third modification of the present invention.

A third modification is explained with reference to FIG. 14. A cleaning element 103 of the third modification is different in the structure of the holding space 130 from the cleaning element 100 of the above-described embodiment.

In the cleaning element 103 of the third modification, the holding space 130 is formed separately from the base 120. Specifically, a bonding sheet region 125A is formed by contact of prescribed surfaces of a fifth sheet element 125 with each other. A prescribed area of the bonding sheet region 125A is then welded to form a sixth bonded part 146.

In this manner, the holding space 130 extending in the longitudinal direction Y is formed.

In the third modification, the central bonded part 140 bonds only the brush part 110 and the base 120. The fifth sheet element 125 is bonded to the base 120, for example, by an adhesive, to form a seventh bonded part 147.

In the cleaning element 103 of the third modification, the first strips 151 and the second strips 152 are also formed, so that the same effect as the cleaning element 100 of the above-described embodiment can be obtained.

(Fourth Modification)

Figure 15:
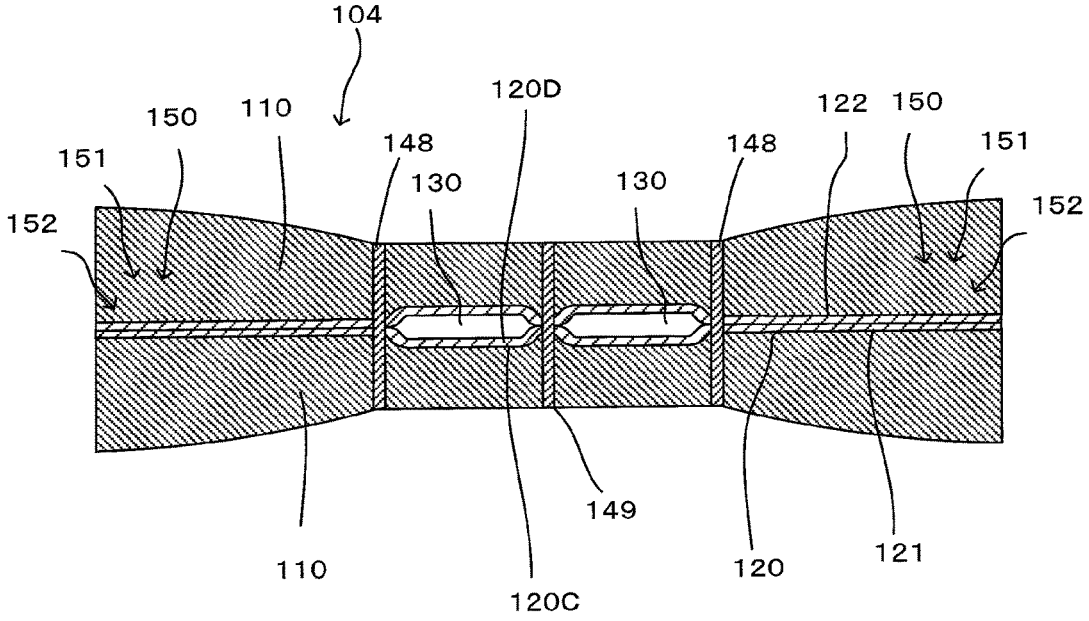
FIG. 15 is an explanatory drawing of a cleaning element according to a fourth modification of the present invention.

A fourth modification is explained with reference to FIG. 15. A cleaning element 104 of the fourth modification is different from the cleaning element 100 of the above-described embodiment in that the brush part 110 is formed not only on the one side 120C of the base 120, but also on the other side 120D of the base 120.

Specifically, the fiber assembly 110GF is superposed on the one side 120C of the base 120, and the second sheet element 122 and the fiber assembly 110GF are superposed on the other side 120D of the base 120. Thus, a laminate in which the base 120 and the second sheet element 122 are sandwiched by the two fiber assemblies 110GF is formed. In this laminate, end regions of the base 120 and the second sheet element 122 in the transverse direction X are welded to form a pair of eighth bonded parts 148. Further, the laminate is welded in a region between the eighth bonded parts 148 to form a ninth bonded part 149. In this manner, the cleaning element 104 is formed.

In the cleaning element 104 of the fourth modification, the first strips 151 and the second strips 152 are also formed, so that the same effect as the cleaning element 100 of the above-described embodiment can be obtained.

Further, by providing the brush part 110 on the other side 120D of the base 120 as well, the user convenience is enhanced.

(Fifth Modification)

Figure 16:
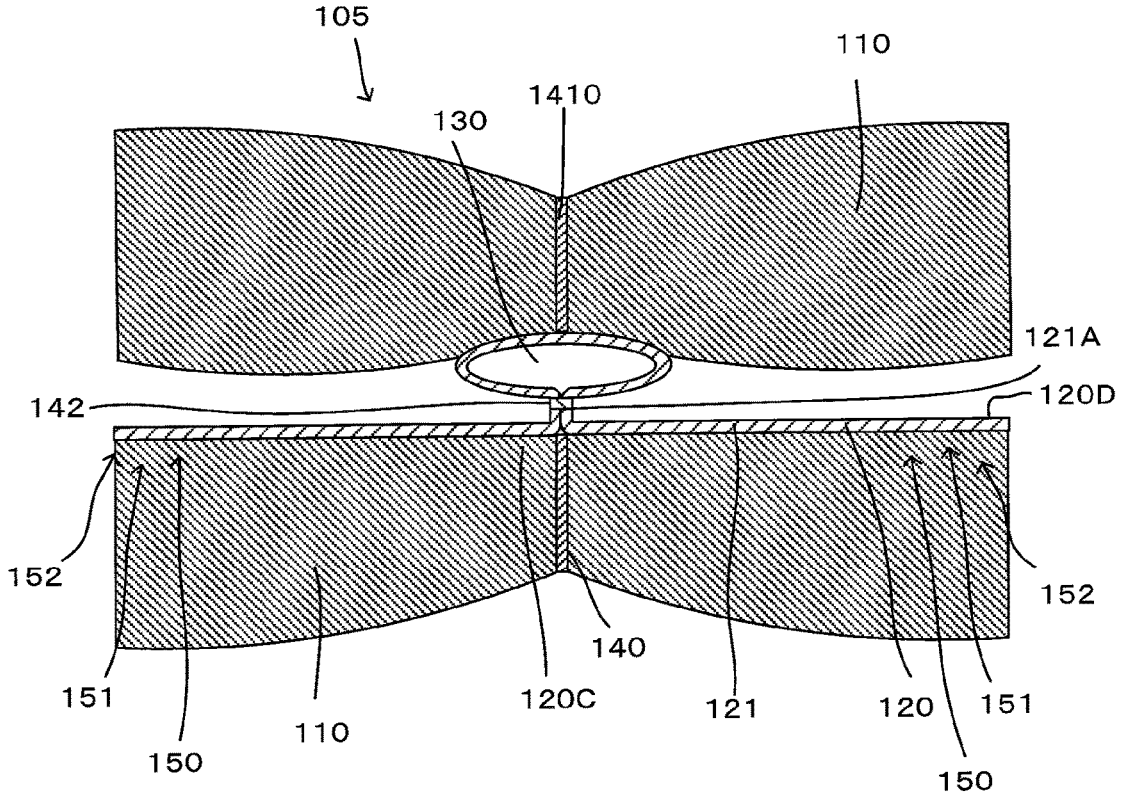
FIG. 16 is an explanatory drawing of a cleaning element according to a fifth modification of the present invention.

A fifth modification is explained with reference to FIG. 16. A cleaning element 105 of the fifth modification is different from the cleaning element 101 of the above-described first modification in that the brush part 110 is formed not only on the one side 120C of the base 120, but also on the other side 120D of the base 120.

Specifically, the fiber assembly 110GF is bonded on the first sheet element 121 which forms the holding space 130. The fiber assembly 110GF on the other side 120D of the base 120 is welded at the central region. This welded part forms a tenth bonded part 1410. The fiber assembly 110GF having the tenth bonded part 1410 is then bonded to the first sheet element 121 forming the holding space 130, for example, by an adhesive (not shown). In this manner, the cleaning element 105 is formed.

In the cleaning element 105 of the fifth modification, the first strips 151 and the second strips 152 are also formed, so that the same effect as the cleaning element 100 of the above-described embodiment can be obtained.

Further, by providing the brush part 110 on the other side 120D of the base 120 as well, the user convenience is further enhanced compared with the cleaning element 101 of the above-described first modification.

(Sixth Modification)

Figure 17:
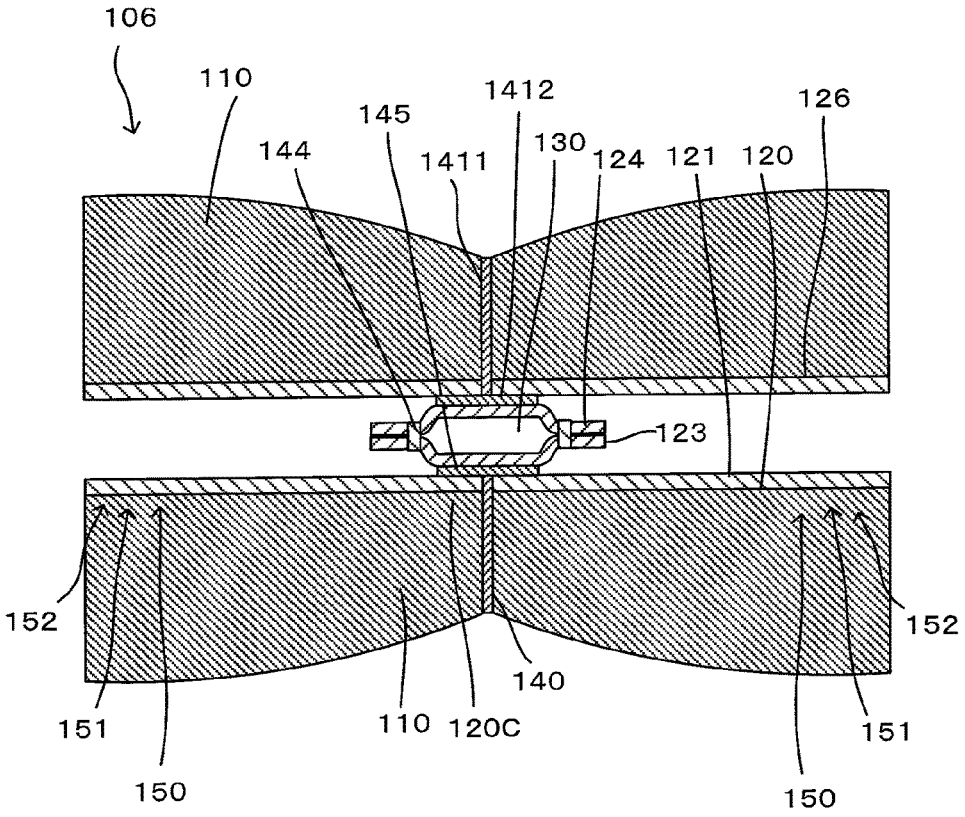
FIG. 17 is an explanatory drawing of a cleaning element according to a sixth modification of the present invention.

A sixth modification is explained with reference to FIG. 17. A cleaning element 106 of the sixth modification is different from the cleaning element 102 of the above-described second modification in that the brush part 110 is formed not only on the one side 120C of the base 120, but also on the other side 120D of the base 120.

Specifically, the fiber assembly 110GF and a sixth sheet element 126 are welded together at the central region to form an 11th bonded part 1411. A side of the sixth sheet element 126 on which the fiber assembly 110GF is not disposed is bonded to the fourth sheet element 124, for example, by an adhesive, to form a 12th bonded part 1412. In this manner, the cleaning element 106 is formed.

In the cleaning element 106 of the sixth modification, the first strips 151 and the second strips 152 are also formed, so that the same effect as the cleaning element 100 of the above-described embodiment can be obtained.

Further, by providing the brush part 110 on the other side 120D of the base 120 as well, the user convenience is further enhanced compared with the cleaning element 102 of the above-described second modification.

(Seventh Modification)

Figure 18:
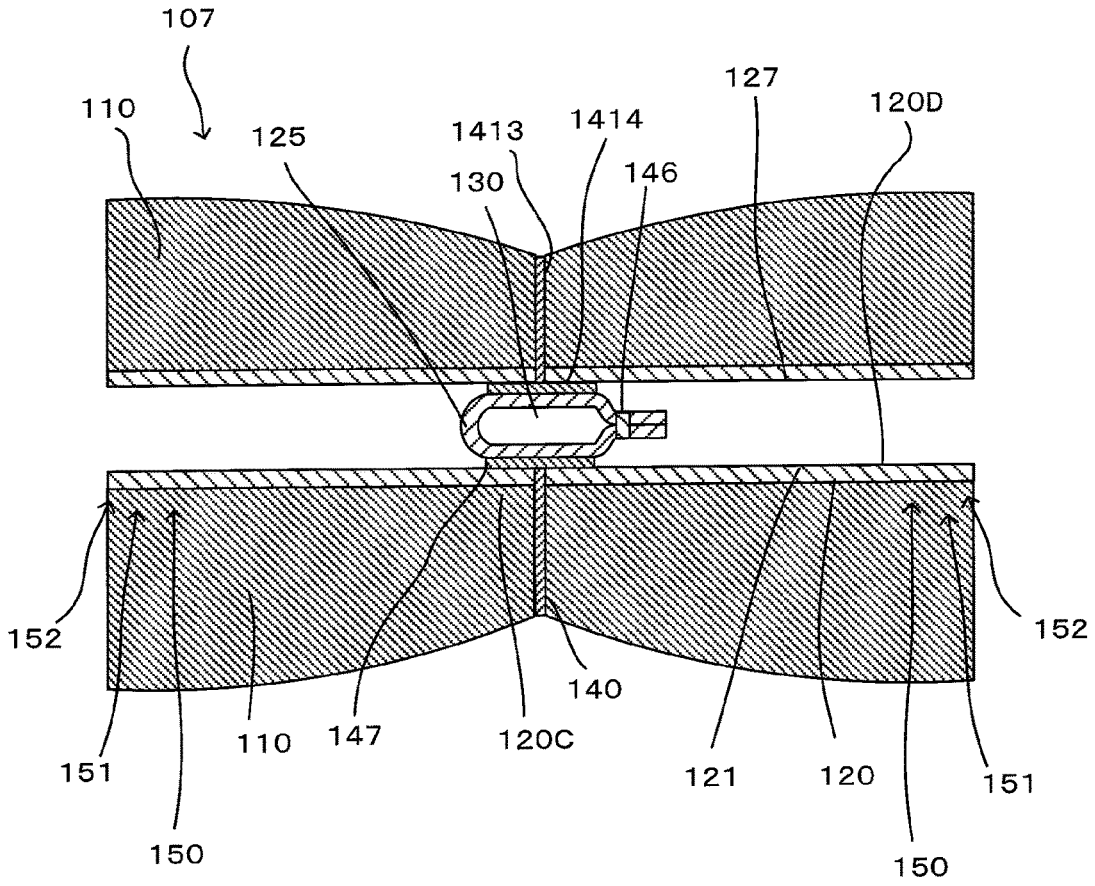
FIG. 18 is an explanatory drawing of a cleaning element according to a seventh modification of the present invention.

A seventh modification is explained with reference to FIG. 18. A cleaning element 107 of the seventh modification is different from the cleaning element 103 of the above-described third modification in that the brush part 110 is formed not only on the one side 120C of the base 120, but also on the other side 120D of the base 120.

Specifically, the fiber assembly 110GF and a seventh sheet element 127 are welded together at the central region to form a 13th bonded part 1413. A side of the seventh sheet element 127 on which the fiber assembly 110GF is not disposed is bonded to the fifth sheet element 125, for example, by an adhesive, to form a 14th bonded part 1414. In this manner, the cleaning element 107 is formed.

In the cleaning element 107 of the seventh modification, the first strips 151 and the second strips 152 are also formed, so that the same effect as the cleaning element 100 of the above-described embodiment can be obtained.

Further, by providing the brush part 110 on the other side 120D of the base 120 as well, the user convenience is further enhanced compared with the cleaning element 103 of the above-described third modification.

(Eighth Modification)

Figure 19:
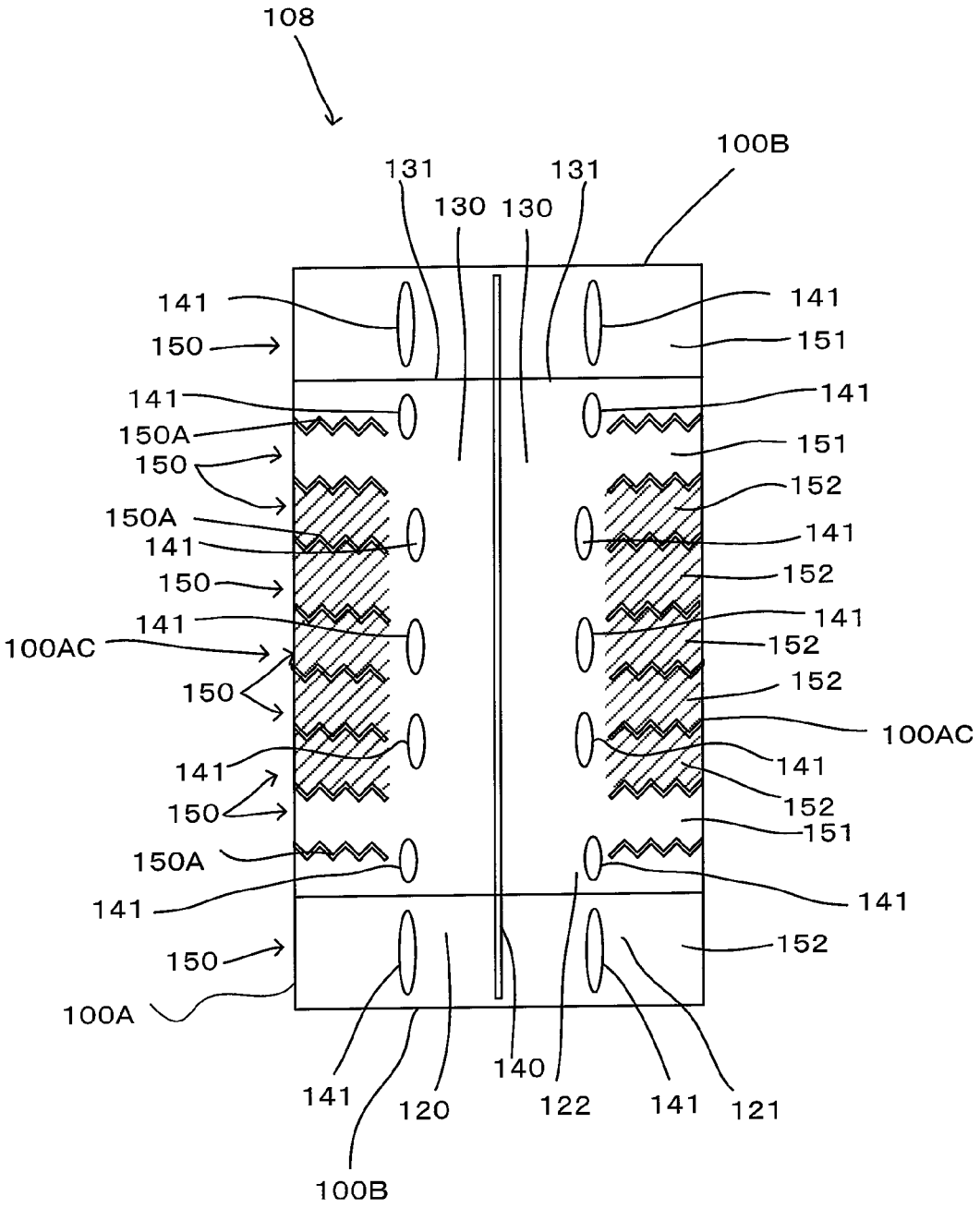
FIG. 19 is a plan view of a cleaning element according to an eighth modification of the present invention.

An eighth modification is explained with reference to FIG. 19. A cleaning element 108 of the eighth modification is different from the cleaning element 100 of the above-described embodiment in that the second strips 152 are formed in the central region 100AC on the ends 100A in the cleaning element transverse direction X. The first strips 151 are arranged in regions in which the ends 100A in the cleaning element transverse direction meet the ends 100B in the cleaning element longitudinal direction.

In the cleaning element 108 of the eighth modification, the first strips 151 and the second strips 152 are also formed, so that basically the same effect as the cleaning element 100 of the above-described embodiment can be obtained. Further, by provision of different position arrangement of the second strips 152 from the cleaning element 100 of the above-described embodiment, the cleaning element 108 of the eighth modification can achieve higher cleaning efficiency with respect to specific objects to be cleaned than the cleaning element 100 of the above-described embodiment.

(Ninth Modification)

Figure 20:
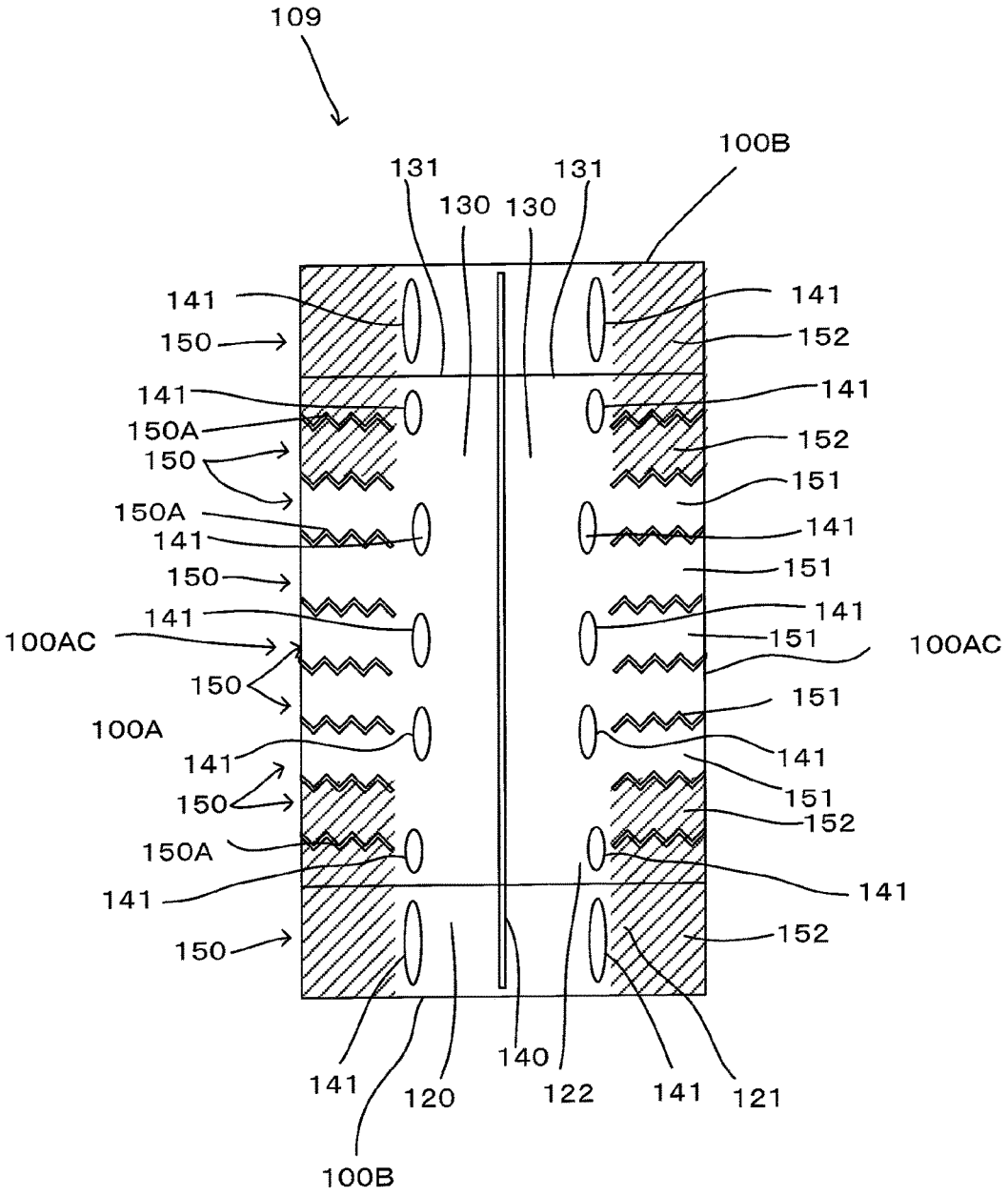
FIG. 20 is a plan view of a cleaning element according to a ninth modification of the present invention.

A ninth modification is explained with reference to FIG. 20. A cleaning element 109 of the ninth modification is different from the cleaning element 100 of the above-described embodiment in that the first strips 151 are formed in the central region 100AC on the ends 100A in the cleaning element transverse direction X. The second strips 152 are arranged in regions in which the ends 100A in the cleaning element transverse direction meet the ends 100B in the cleaning element longitudinal direction In the cleaning element 109 of the ninth modification, the first strips 151 and the second strips 152 are also formed, so that basically the same effect as the cleaning element 100 of the above-described embodiment can be obtained. Further, by provision of different position arrangement of the second strips 152 from the cleaning element 100 of the above-described embodiment, the cleaning element 109 of the ninth modification can achieve higher cleaning efficiency with respect to specific objects to be cleaned than the cleaning element 100 of the embodiment.

The strips 150 can also be provided on the ends 100B of the cleaning element in the cleaning element longitudinal direction Y. Such modifications are now explained with reference to FIGS. 21 to 23. In the description of the modifications shown in FIGS. 21 to 23, for the sake of convenience, detailed description of the strips 150 on the ends 100A in the cleaning element transverse direction X is omitted. In the modifications shown in FIGS. 21 to 23, naturally, the strips 150 on the ends 100A in the cleaning element transverse direction X can also have the first strips 151 and the second strips 152.

(Tenth Modification)

Figure 21:
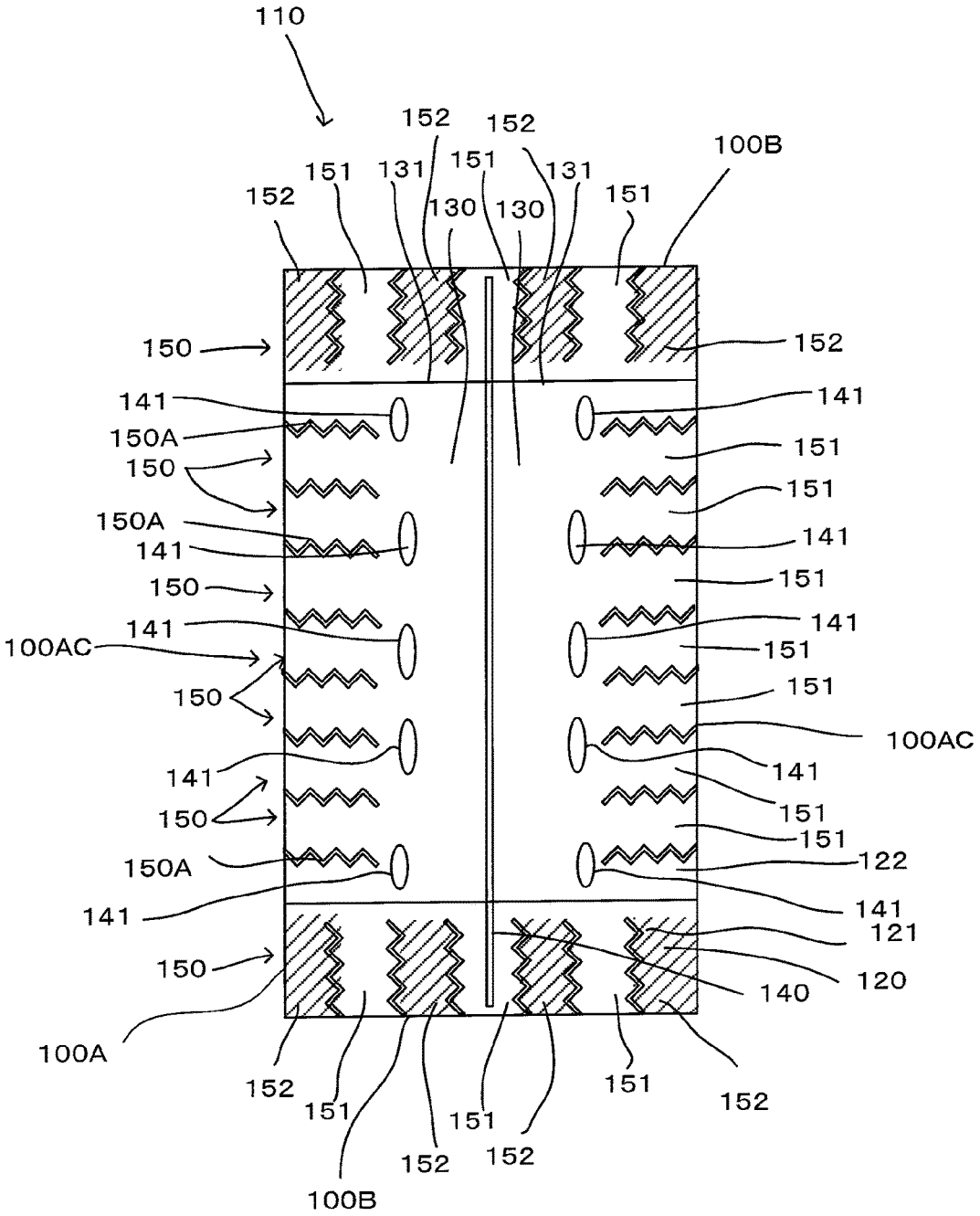
FIG. 21 is a plan view of a cleaning element according to a tenth modification of the present invention.

A tenth modification is explained with reference to FIG. 21. A cleaning element 110 of the tenth modification is different from the cleaning element 100 of the above-described embodiment in that the first strips 151 and the second strips 152 are alternately arranged on the ends 100B in the cleaning element longitudinal direction Y.

In the cleaning element 110 of the tenth modification, the first strips 151 and the second strips 152 are also formed, so that basically the same effect as the cleaning element 100 of the above-described embodiment can be obtained. Further, by provision of different position arrangement of the second strips 152 from the cleaning element 100 of the above-described embodiment, the cleaning element 110 of the tenth modification can achieve higher cleaning efficiency with respect to specific objects to be cleaned than the cleaning element 100 of the embodiment.

(11th Modification)

Figure 22:
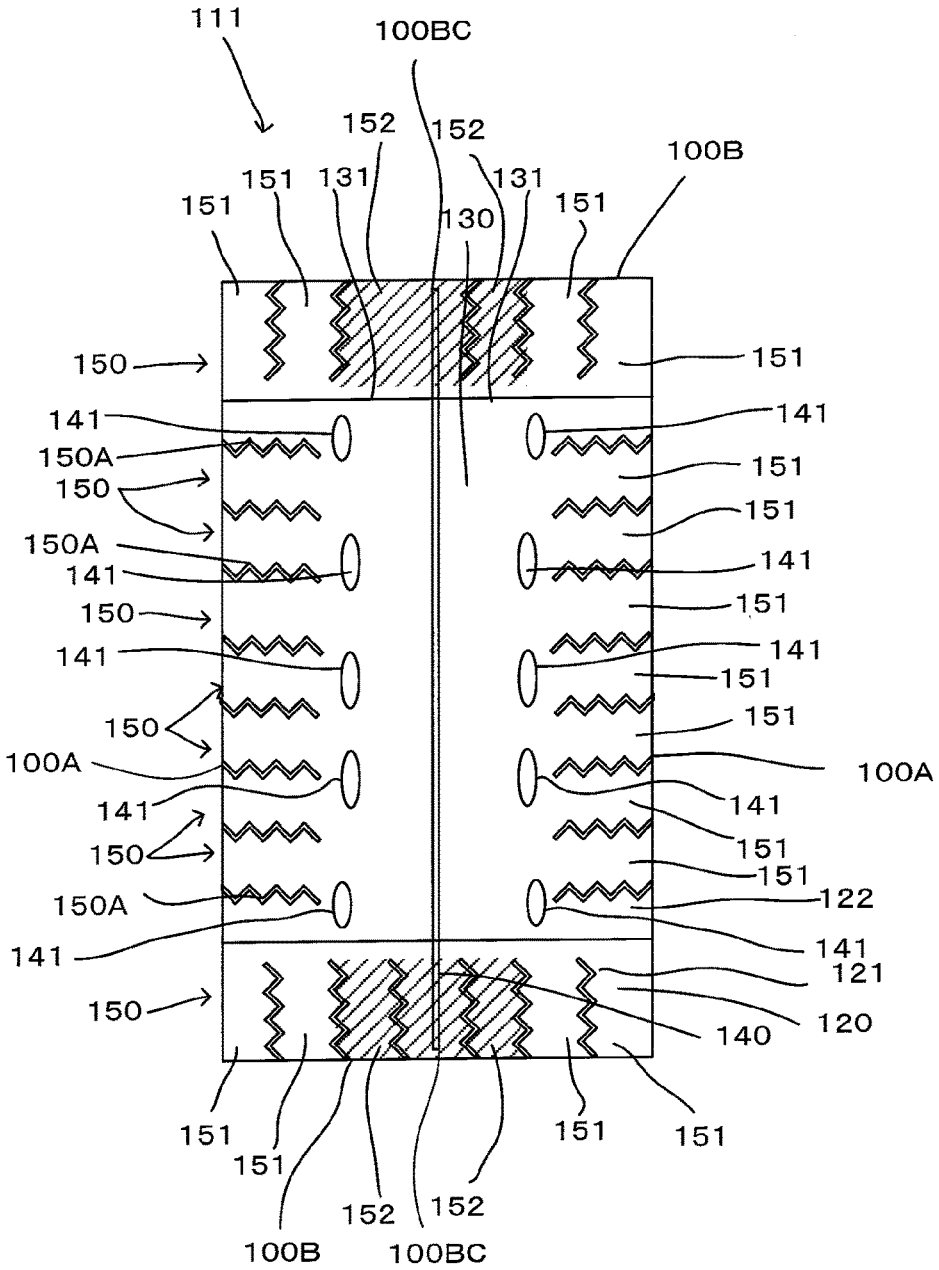
FIG. 22 is a plan view of a cleaning element according to an 11th modification of the present invention.

An 11th modification is explained with reference to FIG. 22. A cleaning element 111 of the 11th modification is different from the cleaning element 100 of the above-described embodiment in that the second strips 152 are formed in the central region 100BC on the ends 100B in the cleaning element longitudinal direction Y. The first strips 151 are arranged in regions in which the ends 100A in the cleaning element transverse direction meet the ends 100B in the cleaning element longitudinal direction.

In the cleaning element 111 of the 11th modification, the first strips 151 and the second strips 152 are also formed, so that basically the same effect as the cleaning element 100 of the above-described embodiment can be obtained. Further, by provision of different position arrangement of the second strips 152 from the cleaning element 100 of the above-described embodiment, the cleaning element 111 of the 11th modification can achieve higher cleaning efficiency with respect to specific objects to be cleaned than the cleaning element 100 of the embodiment.

(12th Modification)

Figure 23:
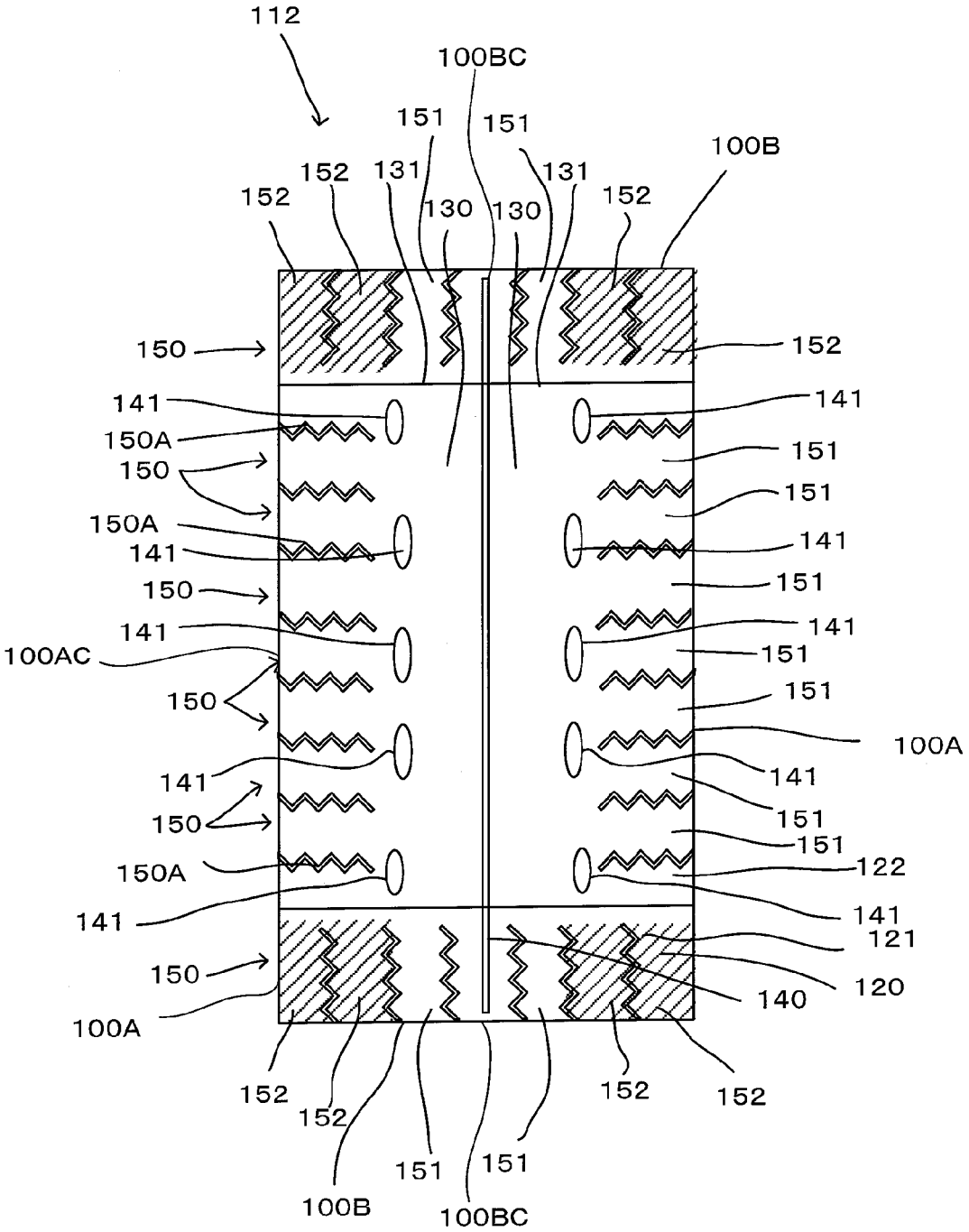
FIG. 23 is a plan view of a cleaning element according to a 12th modification of the present invention.

A 12th modification is explained with reference to FIG. 23. A cleaning element 112 of the 12th modification is different from the cleaning element 100 of the above-described embodiment in that the first strips 151 are formed in the central region 100BC on the ends 100B in the cleaning element longitudinal direction Y. The second strips 152 are arranged in regions in which the ends 100A in the cleaning element transverse direction meet the ends 100B in the cleaning element longitudinal direction.

In the cleaning element 112 of the 12th modification, the first strips 151 and the second strips 152 are also formed, so that basically the same effect as the cleaning element 100 of the above-described embodiment can be obtained. Further, by provision of different position arrangement of the second strips 152 from the cleaning element 100 of the above-described embodiment, the cleaning element 112 of the 12th modification can achieve higher cleaning efficiency with respect to specific objects to be cleaned than the cleaning element 100 of the embodiment.

Embodiments and modifications of the present invention are not limited to those described above. The structures or features of the above-described embodiment and modifications can be appropriately used in combination, and can be added to, changed, replaced with alternatives or otherwise modified.

(Correspondences Between the Features of the Embodiment and the Features of the Invention)

The cleaning tool A is an example embodiment that corresponds to the "cleaning tool" according to this invention. The cleaning element 100, 101, 102, 103, 104, 105, 106, 107, 108, 109, 110, 111, 112 is an example embodiment that corresponds to the "cleaning sheet" according to this invention. The cleaning element holder 200 is an example embodiment that corresponds to the "holder" according to this invention. The cleaning element longitudinal direction Y and the cleaning element transverse direction X are example embodiments that correspond to the "cleaning sheet longitudinal direction" and the "cleaning sheet transverse direction", respectively, according to this invention. The cleaning element holding part 220 is an example embodiment that corresponds to the "holding part" according to this invention. The handle part 210 is an example embodiment that corresponds to the "grip part" according to this invention. The brush part 110 is an example embodiment that corresponds to the "brush part" according to this invention. The base 120 is an example embodiment that corresponds to the "base" according to this invention. The holding space 130 is an example embodiment that corresponds to the "insertion part" according to this invention. The strip 150 is an example embodiment that corresponds to the "strip" according to this invention. The first strip 151, the second strip 152 and the scraping-out part 152A are example embodiments that correspond to the "first strip", "second strip" and the "scraping-out part", respectively, according to this invention. The high rigidity region 152B is an example embodiment that corresponds to the "high rigidity region" according to this invention. The strip longitudinal direction 150Y and the strip transverse direction 150X are example embodiments that correspond to the "strip longitudinal direction" and the "strip transverse direction", respectively, according to this invention. The first sheet element 121, the second sheet element 122, the third sheet element 123, the fourth sheet element 124 and the fifth sheet element 125 are example embodiments that correspond to the "first sheet element", the "second sheet element", the "third sheet element", the "fourth sheet element" and the "fifth sheet element", respectively, according to this invention. The one side 120C and the other side 120D are example embodiments that correspond to the "one side" and "the other side", respectively, according to this invention.

In view of the nature of the above-described invention, a cleaning tool according to this invention can be provided with various features as follows.

(Aspect 1)

A cleaning tool, having a cleaning sheet and a holder for holding the cleaning sheet, wherein:

the cleaning sheet is configured to extend in a longitudinal direction which is defined by a direction of insertion of the holder into the cleaning sheet, and in a transverse direction which is defined by a direction crossing the longitudinal direction, the holder has a holding part for holding the cleaning sheet, and a grip part which is connected to the holding part and designed to be held by a user, the cleaning sheet has a brush part capable of cleaning an object to be cleaned, a base connected with the brush part, and an insertion part which is formed on the base and into which the holding part is inserted, the brush part includes a plurality of strips formed by strip-like sheets, the strips include first strips and second strips having a higher rigidity than the first strips, and each of the second strips has a scraping-out part capable of scraping out dust on the object to be cleaned.

(Aspect 2)

The cleaning tool as defined in aspect 1, wherein the second strip has a high rigidity region.

(Aspect 3)

The cleaning tool as defined in aspect 2, wherein each of the strips is configured to extend in a strip longitudinal direction which is defined by a direction in which the strip extends in an elongate form, and in a strip transverse direction which is defined by a direction crossing the strip longitudinal direction, and the high rigidity region is configured to extend in the strip longitudinal direction.

(Aspect 4)

The cleaning tool as defined in any one of aspects 1 to 3, wherein the second strips are provided in end regions of the cleaning sheet in the cleaning sheet longitudinal direction.

(Aspect 5)

The cleaning tool as defined in any one of aspects 1 to 3, wherein the second strips are provided in a central region of the cleaning sheet in the cleaning sheet longitudinal direction.

(Aspect 6)

The cleaning tool as defined in any one of aspects 1 to 3, wherein the second strips are provided in end regions of the cleaning sheet in the cleaning sheet transverse direction.

(Aspect 7)

The cleaning tool as defined in any one of aspects 1 to 3, wherein the second strips are provided in a central region of the cleaning sheet in the cleaning sheet transverse direction.

(Aspect 8)

The cleaning tool as defined in any one of aspects 1 to 7, wherein the first strips and the second strips are alternately arranged.

(Aspect 9)

The cleaning tool as defined in any one of aspects 1 to 8, wherein the base comprises a first sheet element.

(Aspect 10)

The cleaning tool as defined in claim 9, wherein the base has a plurality of cuts in end regions of the first sheet element, and the strips are formed between the cuts.

(Aspect 11)

The cleaning tool as defined in aspect 9 or 10, comprising a second sheet element which is superposed on the first sheet element, wherein the insertion part is formed between the first sheet element and the second sheet element.

(Aspect 12)

The cleaning tool as defined in aspect 9 or 10, wherein the insertion part is formed by forming a bonding sheet region by contact of prescribed surfaces of the first sheet element with each other and bonding the prescribed surfaces in the bonding sheet region.

(Aspect 13)

The cleaning tool as defined in aspect 9 or 10, comprising a third sheet element which is superposed on the first sheet element, and a fourth sheet element which is superposed on the third sheet element, wherein the insertion part is formed between the third sheet element and the fourth sheet element.

(Aspect 14)

The cleaning tool as defined in aspect 9 or 10, comprising a fifth sheet element which is superposed on the first sheet element, wherein the insertion part is formed by forming a bonding sheet region by contact of prescribed surfaces of the fifth sheet element with each other and bonding the prescribed surfaces in the bonding sheet region.

(Aspect 15)

The cleaning tool as defined in any one of aspects 1 to 14, wherein the brush part is provided on one side of the base.

(Aspect 16)

The cleaning tool as defined in any one of aspects 1 to 14, wherein the brush part is provided on one side and the other side of the base.

(Aspect 17)

The cleaning tool as defined in any one of aspects 1 to 16, wherein the scraping-out part is formed on ends of the high rigidity region.

(Aspect 18)

The cleaning tool as defined in any one of aspects 1 to 17, wherein the second strips are arranged in regions in which ends of the cleaning element in the cleaning element transverse direction meet ends in the cleaning element longitudinal direction.

The invention claimed is:

1. A cleaning tool, comprising:

a cleaning sheet; and a holder for holding the cleaning sheet, wherein the cleaning sheet extends in a cleaning sheet longitudinal direction which is defined by a direction of insertion of the holder into the cleaning sheet, and in a cleaning sheet transverse direction crossing the cleaning sheet longitudinal direction, the holder has a holding part for holding the cleaning sheet, and a grip part which is connected to the holding part and configured to be held by a user, the cleaning sheet has a brush part configured to clean an object to be cleaned, a base connected with the brush part, and an insertion part which is formed on the base and into which the holding part is configured to be inserted, the brush part and the base are superimposed one over another in a cleaning sheet thickness direction of the cleaning sheet, the cleaning sheet thickness direction crossing the cleaning sheet longitudinal direction and the cleaning sheet transverse direction, the base part has a plurality of strips formed by strip-shaped sheets, the strips include first strips and second strips having a higher rigidity than the first strips, each of the second strips has a scraping-out part configured to scrap out dust on the object to be cleaned, the base part includes at least a first sheet element having both the first and second strips, and the first strips and the second strips are alternately arranged in the cleaning sheet transverse direction or in the cleaning sheet longitudinal direction.

2. The cleaning tool as defined in claim 1, wherein each of the second strips has a high rigidity region.

3. The cleaning tool as defined in claim 2, wherein each of the first and second strips extends in a strip longitudinal direction which is defined by a direction in which the strip extends in an elongate form, and in a strip transverse direction crossing the strip longitudinal direction, and the high rigidity region extends in the strip longitudinal direction.

4. The cleaning tool as defined in claim 1, wherein the second strips are provided in end regions of the cleaning sheet in the cleaning sheet longitudinal direction.

5. The cleaning tool as defined in claim 1, wherein the second strips are provided in a central region of the cleaning sheet in the cleaning sheet longitudinal direction.

6. The cleaning tool as defined in claim 1, wherein the second strips are provided in end regions of the cleaning sheet in the cleaning sheet transverse direction.

7. The cleaning tool as defined in claim 1, wherein the second strips are provided in a central region of the cleaning sheet in the cleaning sheet transverse direction.

8. The cleaning tool as defined in claim 1, wherein
the base has a plurality of cuts in end regions of the first sheet element, and
the first and second strips are formed between the cuts.

9. The cleaning tool as defined in claim 1, wherein
the cleaning sheet further comprises a second sheet element which is superposed on the first sheet element, and
the insertion part is formed between the first sheet element and the second sheet element.

10. The cleaning tool as defined in claim 1, wherein the insertion part is formed by forming a bonding sheet region by contact of prescribed surfaces of the first sheet element with each other and bonding the prescribed surfaces in the bonding sheet region.

11. The cleaning tool as defined in claim 1, wherein
the cleaning sheet further comprises
a third sheet element which is superposed on the first sheet element, and
a fourth sheet element which is superposed on the third sheet element, and
the insertion part is formed between the third sheet element and the fourth sheet element.

12. The cleaning tool as defined in claim 1, wherein
the cleaning sheet further comprises a fifth sheet element which is superposed on the first sheet element, and
the insertion part is formed by forming a bonding sheet region by contact of prescribed surfaces of the fifth sheet element with each other and bonding the prescribed surfaces in the bonding sheet region.

13. The cleaning tool as defined in claim 1, wherein the brush part is provided on one side of the base.

14. The cleaning tool as defined in claim 1, wherein the brush part is provided on one side and the other side of the base.

15. The cleaning tool as defined in claim 9, wherein
the second sheet element has both the first and second strips, and
the holder is configured to be inserted in the insertion part between the second sheet element and the first sheet element.

16. A cleaning tool, comprising:
a cleaning sheet; and
a holder for holding the cleaning sheet,
wherein
the cleaning sheet extends in a cleaning sheet longitudinal direction which is defined by a direction of insertion of the holder into the cleaning sheet, and in a cleaning sheet transverse direction crossing the cleaning sheet longitudinal direction,
the holder has a holding part for holding the cleaning sheet, and a grip part which is connected to the holding part and configured to be held by a user,
the cleaning sheet has
a brush part configured to clean an object to be cleaned,
a first sheet element connected with the brush part,
a second sheet element superposed on the first sheet element, and
an insertion part which is formed between the first and second sheet elements and into which the holding part is configured to be inserted,
the second sheet element is shorter than the first sheet element in the cleaning sheet longitudinal direction,
each of the first sheet element and the second sheet element have a plurality of strips formed by strip-shaped sheets,
the strips include first strips and second strips having a higher rigidity than the first strips, and
at least one of the second strips at an end region of the second sheet element in the cleaning sheet longitudinal direction has a scraping-out part configured to scrap out dust on the object to be cleaned.

* * * * *